US008796599B2

(12) United States Patent
Sakakibara et al.

(10) Patent No.: US 8,796,599 B2
(45) Date of Patent: Aug. 5, 2014

(54) INDUCTION HEAT COOKING DEVICE CAPABLE OF PREHEATING OBJECT USING AN OUTPUT VALUE OF AN INFRARED SENSOR

(75) Inventors: Kuniaki Sakakibara, Hyogo (JP); Shintaro Noguchi, Hyogo (JP); Yoshiaki Ishio, Hyogo (JP); Hiroshi Tominaga, Hyogo (JP); Kenji Watanabe, Nara (JP)

(73) Assignee: Panasonic Corporation, Osaka (JP)

( * ) Notice: Subject to any disclaimer, the term of this patent is extended or adjusted under 35 U.S.C. 154(b) by 233 days.

(21) Appl. No.: 12/918,268

(22) PCT Filed: Feb. 19, 2009

(86) PCT No.: PCT/JP2009/000711

§ 371 (c)(1),
(2), (4) Date: Aug. 18, 2010

(87) PCT Pub. No.: WO2009/104404

PCT Pub. Date: Aug. 27, 2009

(65) Prior Publication Data

US 2011/0000904 A1 Jan. 6, 2011

(30) Foreign Application Priority Data

Feb. 19, 2008 (JP) ..... 2008-036828
Mar. 11, 2008 (JP) ..... 2008-061303
Mar. 28, 2008 (JP) ..... 2008-086059

(51) Int. Cl.
*H05B 6/12* (2006.01)

(52) U.S. Cl.
USPC ..... 219/627; 219/625; 99/326; 99/328

(58) Field of Classification Search
USPC ..... 219/413, 482, 506, 610, 620, 624–625, 219/627, 630, 635, 649–650, 656, 660, 219/672; 99/324–328
See application file for complete search history.

(56) References Cited

U.S. PATENT DOCUMENTS 4,013,859 A 3/1977 Peters, Jr.
4,810,847 A 3/1989 Ito (Continued)

FOREIGN PATENT DOCUMENTS

JP 54-138775 A 10/1979
JP 64-033881 A 2/1989

(Continued)

OTHER PUBLICATIONS

Extended European Search Report for European Application No. 0971347.8, dated Oct. 17, 2011, 12 pages.

(Continued)

*Primary Examiner* — Fernando L Toledo
*Assistant Examiner* — Peter Bradford
(74) *Attorney, Agent, or Firm* — Brinks Gilson & Lione

(57) ABSTRACT

An induction heat cooking device is provided that finishes preheating in a short time and maintains the temperature obtained at the finish of the preheating. When a preheating heating mode is selected as an operation mode, a control unit (8) arranged in the induction heat cooking device starts operation in a preheating mode in which a cooking container is heated with a first heating output. When an increment of an output value of an infrared sensor exceeds a first predetermined increment since the heating starts with the first heating output, the control unit causes a notification unit to notify a user that the preheating is finished, and the operation mode is changed to a waiting mode for performing heating with a second heating output that is lower than the first heating output. Further, when the user sets a heating power by means of a heating power setting unit in the preheating mode, the control unit prohibits changing to the heating power set by the user. When the user sets a heating power by means of a heating power setting unit in the waiting mode, the control unit permits changing to the heating power set by the user, and the operation mode is changed to a heating mode for performing heating with a third heating output corresponding to the heating power set by the user.

13 Claims, 15 Drawing Sheets

(56) References Cited

U.S. PATENT DOCUMENTS

| | | | | |
|---|---|---|---|---|
| 5,428,207 | A | 6/1995 | Essig et al. | |
| 5,648,008 | A | 7/1997 | Barritt et al. | |
| 5,961,867 | A | 10/1999 | McWilliams | |
| 6,140,617 | A | 10/2000 | Berkcan et al. | |
| 6,169,486 | B1 | 1/2001 | Berkcan et al. | |
| 6,201,222 | B1 * | 3/2001 | Baker et al. | 219/497 |
| 6,229,130 | B1 * | 5/2001 | Furuta et al. | 219/711 |
| 6,417,513 | B1 | 7/2002 | Hershey et al. | |
| 6,462,316 | B1 | 10/2002 | Berkcan et al. | |
| 6,809,301 | B1 * | 10/2004 | McIntyre et al. | 219/506 |
| 7,786,410 | B2 | 8/2010 | Zhang et al. | |
| 2003/0098888 | A1 * | 5/2003 | Guenther et al. | 345/810 |
| 2004/0060927 | A1 * | 4/2004 | Kim et al. | 219/624 |
| 2004/0245244 | A1 | 12/2004 | Hirota et al. | |
| 2006/0054617 | A1 | 3/2006 | Ryu et al. | |
| 2006/0081607 | A1 * | 4/2006 | Niiyama et al. | 219/497 |
| 2006/0237450 | A1 | 10/2006 | Uchida et al. | |
| 2007/0023420 | A1 * | 2/2007 | Gagas | 219/623 |
| 2007/0080158 | A1 * | 4/2007 | Takimoto | 219/627 |
| 2007/0278216 | A1 | 12/2007 | Tominaga et al. | |
| 2007/0295718 | A1 * | 12/2007 | Takei et al. | 219/756 |
| 2008/0121633 | A1 | 5/2008 | Pinilla et al. | |
| 2009/0014438 | A1 | 1/2009 | Ohashi et al. | |
| 2009/0134149 | A1 * | 5/2009 | Keishima et al. | 219/647 |
| 2009/0321424 | A1 * | 12/2009 | Bunuel Magdalena et al. | 219/620 |
| 2010/0051608 | A1 | 3/2010 | Tominaga et al. | |
| 2010/0176120 | A1 | 7/2010 | Watanabe et al. | |

FOREIGN PATENT DOCUMENTS

| | | | |
|---|---|---|---|
| JP | 05-326129 | A | 12/1993 |
| JP | 08-330064 | A | 12/1996 |
| JP | 10-069971 | A | 3/1998 |
| JP | 10-172746 | A | 6/1998 |
| JP | 2000-268951 | A | 9/2000 |
| JP | 2002-367765 | A | 12/2002 |
| JP | 2004-069112 | A | 3/2004 |
| JP | 2004-227816 | A | 8/2004 |
| JP | 2004-278905 | A | 10/2004 |
| JP | 2005-038654 | A | 2/2005 |
| JP | 2005-251558 | A | 9/2005 |
| JP | 2005-259540 | A | 9/2005 |
| JP | 2006-004875 | A | 1/2006 |
| JP | 2006-086023 | A | 3/2006 |
| JP | 2006-120552 | A | 5/2006 |
| JP | 2006-344456 | A | 12/2006 |
| JP | 2007-059412 | A | 3/2007 |
| JP | 2007-115516 | A | 5/2007 |
| JP | 2007-227044 | A | 9/2007 |
| JP | 2007-324145 | A | 12/2007 |
| JP | 2008-027638 | A | 2/2008 |
| JP | 2008-027730 | A | 2/2008 |
| JP | 2008269912 | A * | 11/2008 |
| JP | 2008-311000 | A | 12/2008 |
| WO | WO 2004/103028 | A1 | 11/2004 |
| WO | WO 2006/126345 | A1 | 11/2006 |
| WO | WO 2007/055218 | * | 5/2007 |
| WO | WO 2007/091597 | A1 | 8/2007 |
| WO | WO 2007/144309 | A1 | 12/2007 |
| WO | WO 2008/010435 | A1 | 1/2008 |
| WO | WO 2008/120447 | A1 | 10/2008 |
| WO | WO 2008/155923 | A1 | 12/2008 |

OTHER PUBLICATIONS

International Preliminary Report on Patentability for International Application No. PCT/JP2009/000711, dated Oct. 5, 2010, 6 pages.

International Search Report for International Application No. PCT/JP2009/000711, dated Jun. 2, 2009, 2 pages.

Office action from co-pending U.S. Appl. No. 12/918,271, dated Nov. 6, 2013, 13 pages.

Office Action from co-pending U.S. Appl. No. 12/918,271, dated Apr. 4, 2013, 11 pages.

Office Action from co-pending U.S. Appl. No. 12/918,271, dated Aug. 6, 2012, 11 pages.

* cited by examiner

INDUCTION HEAT COOKING DEVICE CAPABLE OF PREHEATING OBJECT USING AN OUTPUT VALUE OF AN INFRARED SENSOR

TECHNICAL FIELD

The present invention relates to an induction heat cooking device for heating an object to be heated such as a cooking container.

BACKGROUND ART

In recent years, induction heat cooking devices for heating cooking containers such as a pot and a frying pan with a heating coil by induction have been widely used in ordinary households and commercial-use kitchens. The induction heat cooking device includes a heat sensitive element such as a thermistor on a lower surface of a top plate to detect the temperature of the bottom surface of a cooking container with the heat sensitive element, and controls the heating coil so that the detected temperature agrees with a target temperature. For example, when the cooking container is preheated before fried food are cooked, the induction heat cooking device controls the heating coil so that the temperature detected by the heat sensitive element reaches a preheating target temperature.

When a pot contains a large amount of oil and food, for example, when fried food is cooked, (i.e., the load is large), the temperature of the bottom surface of the cooking container gradually increases. In contrast, when a frying pan contains only a small amount of oil (i.e., the load is small), the temperature increases rapidly. In this induction heat cooking device, the heat sensitive element detects the temperature of the bottom surface of the cooking container placed on the top plate by detecting the temperature transferred from the cooking container to the top plate, and therefore, the heat sensitive device has poor temperature following capability with respect to the temperature of the bottom surface of the cooking container. Accordingly, when the temperature of the bottom surface of the cooking container rapidly increases, there is a large error between the actual temperature of the bottom surface of the cooking container and the temperature detected by the heat sensitive element. As a result of this large error, even after the actual temperature of the bottom surface of the cooking container has reached the target temperature, the heat sensitive element cannot detect the actual temperature having reached the target temperature, which causes the induction heat cooking device to continue heating. Therefore, the temperature of the bottom surface of the cooking container may go far beyond the target temperature, and may reach a dangerous temperature such as an oil firing temperature. In order to solve the above problem, a conventional induction heat cooking device detects the temperature gradient of the bottom surface of the cooking container, and stops heating when the temperature gradient is determined to be steeper than a predetermined temperature gradient, thus controlling the heating coil so that the temperature of the bottom surface of the cooking container does not reach a dangerous temperature (for example, refer to Patent Document 1).

Patent Document 1: JP 64-33881 A

Problems to be Solved by the Invention

However, the conventional induction heat cooking device that controls and stops heating based on the temperature gradient calculated based on the temperature detected by the heat sensitive element may fail to stop heating at an appropriate time as described below, when the load is small, for example, when a cooking container having a thin bottom plate is used for cooking of stir-fried food, in which the cooking starts with a small amount of oil.

Since the heat sensitive element detects the temperature of the bottom surface of the cooking container by detecting the temperature of the lower surface of the top plate, a large clearance between the top plate and the bottom surface of the cooking container at the position at which the heat sensitive element detects the temperature would have a great affect on the relationship between the detected temperature and the actual temperature of the bottom surface of the cooking container. In particular, a large clearance is formed between the bottom of the pot and the top plate in a case where the bottom of the pot is warped. In this case, the temperature of the bottom of the pot is less likely to be transferred to the top plate. Accordingly, the temperature gradient calculated from the temperature detected by the heat sensitive element is less than the actual temperature gradient of the bottom of the pot. Therefore, the conventional induction heat cooking device may fail to stop heating at an appropriate time.

When the thickness of the bottom surface of the cooking container is thin, the temperature of the bottom surface of the cooking container rapidly increases. On the other hand, it takes some time for the heat of the bottom surface of the cooking container to be transferred to the lower surface of the top plate. Therefore, even if the heat sensitive element can detect the same slope as the actual temperature gradient of the bottom surface of the cooking container, it takes some time for the heat sensitive element to detect it, and the heat sensitive element may fail to stop heating at an appropriate time.

As described above, the conventional induction heat cooking device often fails to stop heating at an appropriate time because the conventional induction heat cooking device controls and stops heating based on the temperature gradient calculated based on the temperature detected by the heat sensitive element. If the conventional induction heat cooking device fails to stop heating at an appropriate time, the temperature of the bottom surface of the cooking container goes far beyond the target temperature, and there is a problem in that it takes a long time to thereafter stabilize the temperature to the target temperature. On the other hand, in a case where the load is small, it is necessary for the conventional induction heat cooking device to start heating the cooking container with a small heating power so that the temperature of the bottom surface of the cooking container does not go beyond the target temperature. In this case, however, there is a problem in that it takes a long time for the temperature of the bottom surface of the cooking container to reach the target temperature.

Therefore, when the conventional induction heat cooking device heats an object to be heated having a thin bottom plate, there is a problem in that the conventional induction heat cooking device cannot raise the temperature of the object to be heated to the target temperature in a short time, and cannot prevent a transitional temperature with respect to the target temperature from attaining an excessively high temperature. Therefore, while stir-fried food is cooked with a frying pan, the conventional induction heat cooking device cannot finish preheating in a short time, and cannot prevent the frying pan from reaching an excessively high temperature and deforming or getting discolored.

The present invention solves the above problems, and aims at providing an induction heat cooking device that raises the temperature of an object to be heated to a target temperature in a short time and prevents a transitional temperature with respect to the target temperature from attaining an excessively high temperature, even when the object to be heated has a thin bottom plate. More specifically, the present invention aims at providing an induction heat cooking device that can finish preheating in a short time and can prevent a frying pan from reaching an excessively high temperature and deforming or getting discolored, while stir-fried food is cooked with the frying pan. Further, the present invention provides an induction heat cooking device that continues heating to keep an object to be heated at an appropriate temperature after the preheating is finished.

SUMMARY OF THE INVENTION

In order to achieve the above aims, an induction heat cooking device according to the present invention includes a top plate made of a material through which an infrared light is transmitted, a heating coil for receiving a high frequency current to heat a cooking container placed on the top plate by induction, an inverter circuit for providing the high frequency current to the heating coil, an operation unit including an operation mode setting unit for setting an operation mode of the inverter circuit and a heating power setting unit for setting a heating power of the inverter circuit, an infrared sensor for detecting an infrared light that is emitted from a bottom surface of the cooking container and transmitted through the top plate, a control unit for controlling an output of the inverter circuit, based on an output of the infrared sensor and a setting inputted to the operation unit, and a notification unit, wherein the operation mode includes a preheating heating mode for performing preheating before performing heating, wherein when the operation mode is set to the preheating heating mode, the control unit starts operation in a preheating mode for heating the cooking container with a first heating output corresponding to the preheating heating mode, and wherein when an increment of an output value of the infrared sensor is more than a first predetermined increment since the heating starts with the first heating output, the control unit causes the notification unit to notify that the preheating is finished, and the operation mode is changed to a waiting mode for performing heating with a second heating output that is lower than the first heating output, and wherein when a user sets a heating power by means of the heating power setting unit in the preheating mode, change to the heating power set by the user is prohibited, and wherein when the user sets a heating power by means of the heating power setting unit in the waiting mode, change to the heating power set by the user is permitted, and the operation mode is changed to the heating mode for performing heating with a third heating output corresponding to the heating power set by the user.

The operation mode may be changed to the waiting mode when the increment of the output value of the infrared sensor with respect to a predetermined initial output value exceeds the first predetermined increment, instead of the increment of the output value of the infrared sensor since the heating starts with the first heating output. In this case, the predetermined initial value may be an output value of the infrared sensor that is obtained when the cooking container, having such a temperature that the gradient of increase in the output of the infrared sensor with respect to a change of temperature of the cooking container is equal to or less than a predetermined value, is placed on the top plate.

The induction heat cooking device may further include a timer count unit for counting a time from when the operation mode is changed to the waiting mode. In this case, when the time counted by the timer count unit reaches a first predetermined time in the waiting mode, the control unit may halt heating or change the second heating output to a heating output that is smaller than the second heating output.

When the time counted by the timer count unit reaches a first predetermined time, the notification unit may notify the user that the heating is halted or the second heating output is changed to the heating output that is smaller than the second heating output.

When the time counted by the timer count unit reaches a second predetermined time that is shorter than the first predetermined time, the notification unit may issue a notification for prompting the user to start cooking.

The operation unit may include a plurality of switches. In this case, the timer count unit stops counting when a predetermined switch in the operation unit is pressed down before the counted time reaches the first predetermined time.

The operation unit may include a plurality of switches. In this case, when a predetermined switch in the operation unit is pressed down before the counted time reaches the first predetermined time, the timer count unit may reset counting and may start counting all over again, and the timer count unit may reset the first predetermined time to a third predetermined time that is longer than the first predetermined time. When the counted time since the resetting reaches the third predetermined time, the heating may be halted, or the second heating output may be changed to a heating output that is smaller than the second heating output.

The induction heat cooking device may further include a numerical display unit for displaying a number. In this case, the numerical display unit may display how much time it takes for the time counted by the timer count unit to reach the first predetermined time.

The induction heat cooking device may further include a heating power display unit for displaying a heating power. In this case, the heating power display unit may not display the heating power in the preheating mode, and may display the heating power after the operation mode is changed to the waiting mode.

The induction heat cooking device may further include an operation mode display unit for displaying a mark representing the operation mode. In this case, in the preheating mode, the operation mode display unit may light a heating mark indicating that the heating is performed and may blink a preheating mark indicating that the preheating function is operated. When the operation mode is changed to the waiting mode, the operation mode display unit may stop blinking the preheating mark and may light the preheating mark. When the operation mode is changed to the heating mode, the operation mode display unit may light the heating mark and may turn off the preheating mark.

Advantages of the Invention

According to the heat cooking device of the present invention, a preheating function having an excellent usability can be achieved with an infrared sensor. In other words, the change of the output of the infrared sensor is measured, and the temperature of the bottom surface of the cooking container is detected. Accordingly, the actual temperature of the bottom surface of the cooking container can be accurately detected with high thermal responsiveness. Therefore, the heating output can be large, and the object to be heated can be brought to a target temperature in a short time. Thereafter, the output can be reduced immediately, and the object to be heated is maintained at a temperature appropriate for preheating. As a result, the transitional temperature can be prevented from reaching an abnormally high temperature with respect to the target temperature. More specifically, a preheating mode is arranged for operating the preheating function. In the preheating mode, the temperature is controlled with the infrared sensor. Therefore, even when stir-fried food is cooked with a frying pan, the heating power can be set large in the preheating mode, and the preheating can be finished in a short time without damaging the frying pan. In addition, the object to be heated can be maintained at an appropriate temperature by continuing heating after the preheating is finished.

| Description of Reference Signs | |
|---|---|
| 1: | Top plate |
| 2: | Heating coil |
| 2a: | Outer coil |
| 2b: | Inner coil |
| 3: | Infrared sensor |
| 4: | Operation unit |
| 4a to 4f: | Switch |
| 5: | Commercial power source |

-continued

| Description of Reference Signs | |
|---|---|
| 6: | Rectifying/smoothing unit |
| 7: | Inverter circuit |
| 8: | Control unit |
| 9: | Input current detection unit |
| 10: | Object to be heated |
| 11: | Heating portion |
| 12: | Display unit |
| 12a: | Operation mode display unit |
| 12b: | Heating power display unit |
| 12c: | Timer display unit |
| 13: | Notification unit |
| 14: | Light source |
| 15: | Heating coil current detection unit |
| 20: | Timer count unit |
| 31: | Photodiode |
| 32: | Operational amplifier |
| 61: | Full-wave rectifying device |
| 62: | Choke coil |
| 63: | Smoothing capacitor |
| 71: | Resonant capacitor |
| 72: | Diode |
| 73: | Switching device |
| 81: | Heating control unit |
| 82: | Input power integration unit |
| 83: | Material determination unit |

DETAILED DESCRIPTION OF THE PREFERRED EMBODIMENTS

The embodiments of the present invention will be hereinafter described with reference to the drawings.

Embodiment 1

1.1 Structure of Induction Heat Cooking Device

Figure 1:
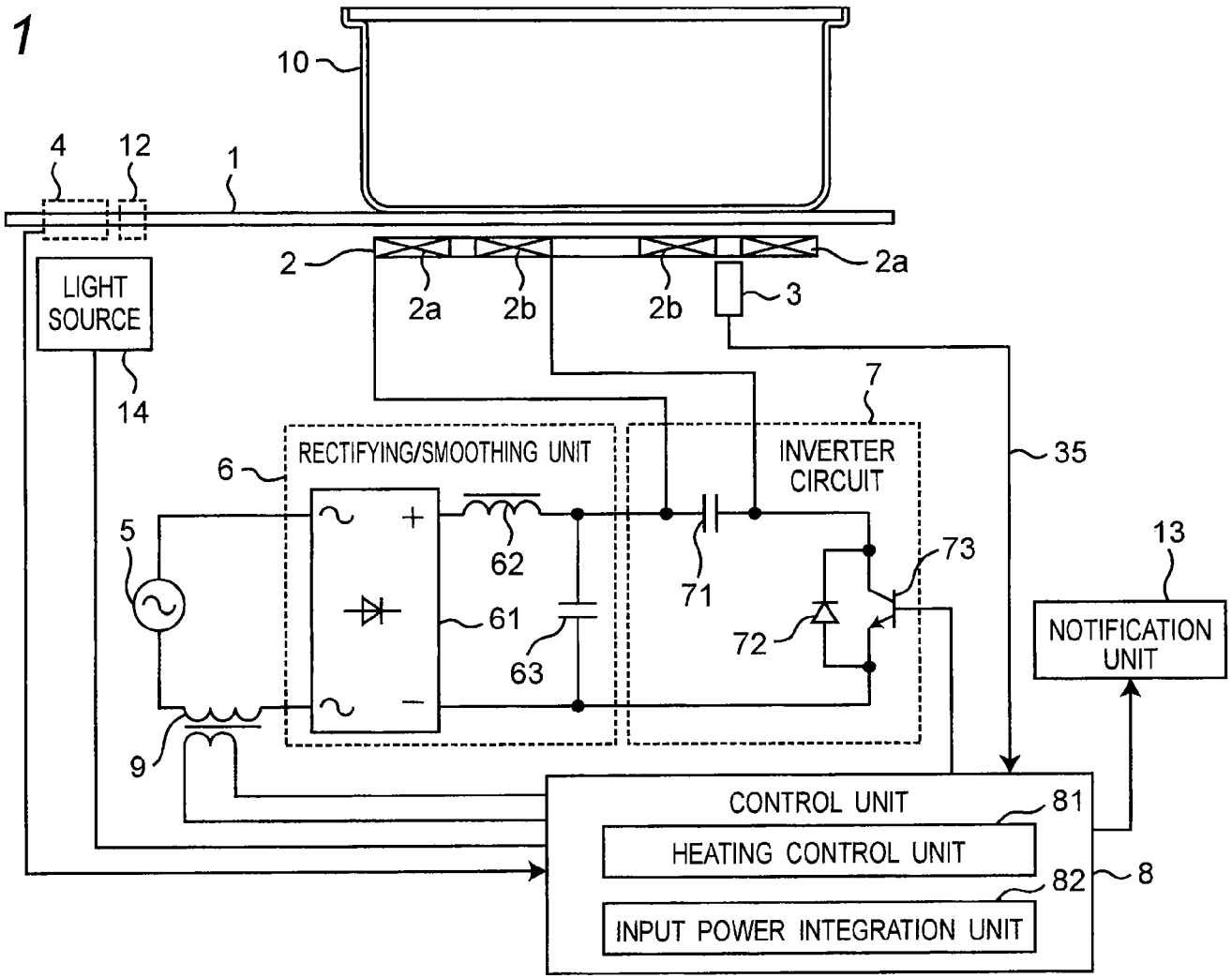
FIG. 1 is a block diagram illustrating a structure of an induction heat cooking device according to Embodiment 1 of the present invention.

FIG. 1 illustrates a structure of an induction heat cooking device according to Embodiment 1 of the present invention. The induction heat cooking device according to the present embodiment has "preheating function" for performing preheating to reach a target temperature before performing heating with a high heating power for stir-fried food and the like. In the controls during preheating and heating, the induction heat cooking device according to the present embodiment uses an output signal corresponding to a temperature of an object 10 to be heated that is obtained by an infrared sensor 3 having high thermal responsiveness. For example, this induction heat cooking device is incorporated into a cabinet of a kitchen and the like.

The induction heat cooking device according to Embodiment 1 of the present invention includes a top plate 1 arranged on the top surface of the device and a heating coil 2 (an outer coil 2*a* and an inner coil 2*b*) for heating the object 10 to be heated on the top plate 1 by induction by generating high frequency magnetic field. The top plate 1 is made of an electrically insulating material such as glass. Infrared light can penetrate through the top plate 1. The heating coil 2 is arranged below the top plate 1. The heating coil 2 is concentrically divided into two parts, i.e., the outer coil 2*a* and the inner coil 2*b*. A clearance is arranged between the outer coil 2*a* and the inner coil 2*b*. The object 10 to be heated is heated by an eddy current generated by the high frequency magnetic field of the heating coil 2.

An operation unit 4 is arranged on the user side of the top plate 1. With the operation unit 4, the user gives instructions such as start/stop. A display unit 12 is arranged between the operation unit 4 and the object 10 to be heated. Below the operation unit 4 and the display unit 12, a light source 14 is arranged to illuminate the operation unit 4 and the display unit 12.

The infrared sensor 3 is arranged below the gap between the outer coil 2*a* and the inner coil 2*b*. Since the high frequency magnetic field of the heating coil 2 is strong at this position, the infrared sensor 3 can detect the approximate maximum temperature of the bottom surface of the object 10 to be heated (an output corresponding to the temperature at a position in the radius direction of the cooking container). The infrared light based on the temperature of the bottom surface of the object 10 to be heated that is emitted from the bottom surface of the object 10 to be heated passes through the top plate 1 and the clearance between the outer coil 2*a* and the inner coil 2*b*, and the infrared sensor 3 receives the infrared light. The infrared sensor 3 detects the received infrared light, and outputs an infrared light detection signal 35 based on the amount of detected infrared light.

Below the heating coil 2, a rectifying/smoothing unit 6 is arranged to convert an alternating voltage provided by a commercial power source 5 into a direct current voltage, and an inverter circuit 7 is arranged to receive the direct current voltage from the rectifying/smoothing unit 6, generate a high frequency current, and output the generated high frequency current to the heating coil 2. An input current detection unit 9 is arranged between the commercial power source 5 and the rectifying/smoothing unit 6 to detect the magnitude of the input current flowing from the commercial power source 5 to the rectifying/smoothing unit 6.

The rectifying/smoothing unit 6 includes a full-wave rectifying device 61 constituted by bridge diodes, and also includes a low pass filter connected to the output terminal of the full-wave rectifying device 61 and constituted by a choke coil 62 and a smoothing capacitor 63. The inverter circuit 7 includes a switching device 73 (in the present embodiment, IGBT), a diode 72 connected in antiparallel with the switching device 73, and a resonant capacitor 71 connected in parallel with the heating coil 2. The switching device 73 of the inverter circuit 7 turns on and off to generate high frequency current. A high frequency inverter is constituted by the inverter circuit 7 and the heating coil 2.

The induction heat cooking device according to the present embodiment further includes a control unit 8 for controlling the operation of the induction heat cooking device. The control unit 8 has a heating control unit 81 for controlling the high frequency current provided from the inverter circuit 7 to the heating coil 2 by controlling ON/OFF state of the switching device 73 of the inverter circuit 7. The heating control unit 81 controls ON/OFF state of the switching device 73 based on a signal transmitted from the operation unit 4 and a temperature detected by the infrared sensor 3.

The control unit 8 further has an input power integration unit 82 for adding up an input power. The input power integration unit 82 adds up the input power based on the input current detected by the input current detection unit 9. For example, the input power integration unit 82 calculates the integration value of the input power since the preheating has started. In a case where the input current is deemed to be approximately constant, the input power integration unit 82 may calculate the integration value of the input power based on the elapsed time. The input power can be calculated from a product of the input current and the input voltage, and accordingly, the input power may be obtained by measuring the input voltage. Alternatively, the input voltage may be deemed to be constant, and the integration value of the input power may be simply calculated from the input current and the elapsed time.

The induction heat cooking device according to the present embodiment further includes a notification unit 13. The notification unit 13 is, for example, a speaker for outputting a beep sound. More specifically, when the preheating is finished, the notification unit 13 outputs a beep sound for notifying the finish of preheating.

Figure 2:
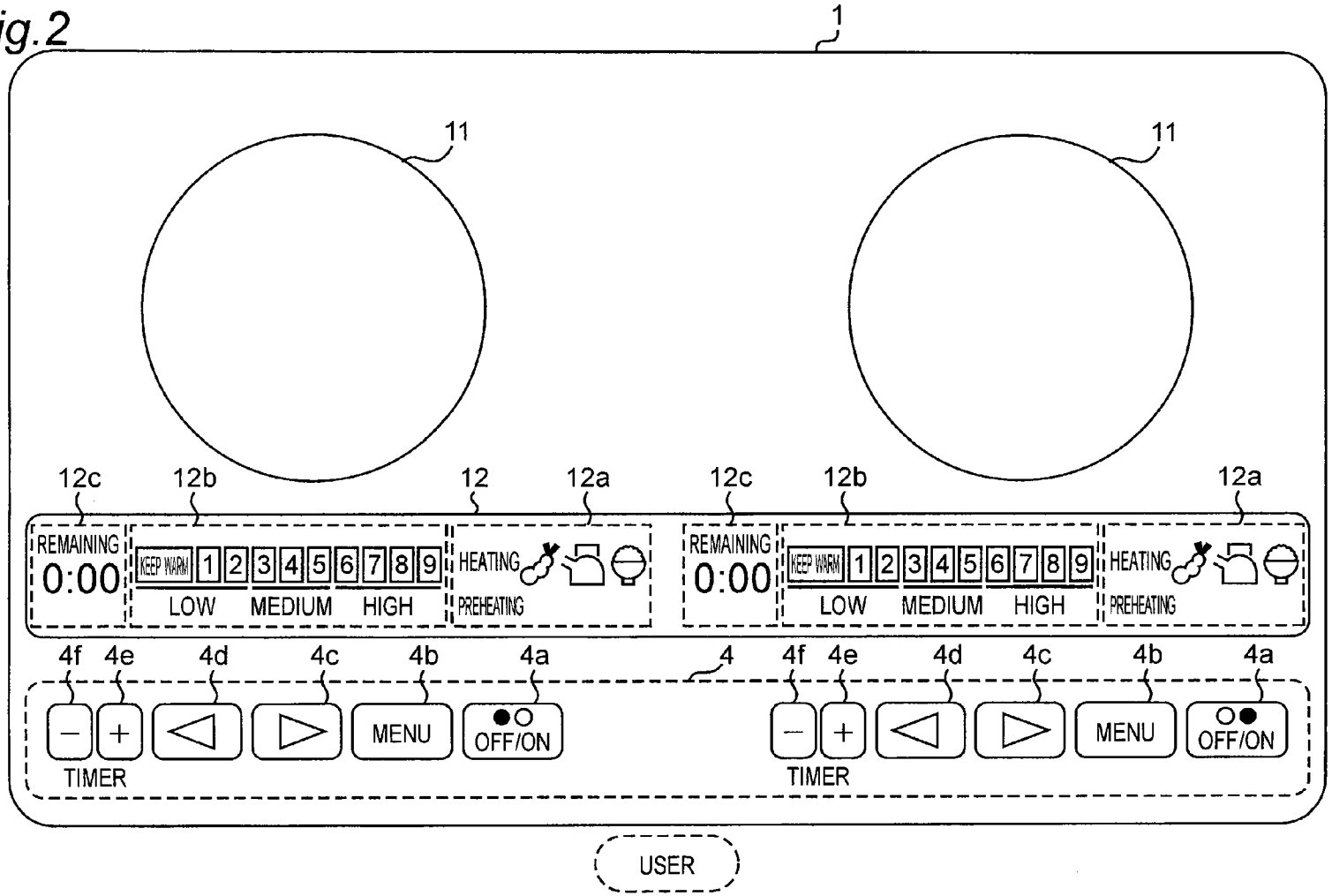
FIG. 2 is a top view illustrating a top plate of FIG. 1.

FIG. 2 illustrates a top view of the top plate 1. At least one heating portion 11 (in the present embodiment, two heating portions 11) are printed and indicated on the upper surface or the lower surface of the top plate 1. The heating portion 11 indicates a position on which the object 10 to be heated is placed. The heating coils 2 are respectively arranged below the heating portions 11. A display unit 12 is arranged at the front side (user side) of the heating portion 11. The control unit 8 controls the light source 14, so as to turn on, blink, and turn off characters and pictures included in the display unit 12.

The display unit 12 includes an operation mode display unit 12*a* indicating an operation mode, a heating power display unit 12*b* indicating the magnitude of the output of the heating coil 2, and a timer display unit 12*c* indicating the remaining time of a timer. The operation mode is a mode for suitably setting the operation of the inverter circuit 7 for various kinds of cooking (for example, preheating, heating, fried food, boiling water, and cooking rice). As shown in the left column of the following Table 1, the induction heat cooking device according to the present embodiment includes five operation modes, i.e., "preheating heating mode", "heating mode", "fried food mode", "water boiling mode", and "rice cooking mode". When the user selects "preheating heating mode", the induction heat cooking device according to the present embodiment performs operation in "preheating mode", "waiting mode", and "heating mode" in order, the details of which will be described in detail later.

TABLE 1

| Selectable operation modes | Actual operation mode in selected operation mode |
|---|---|
| Preheating heating mode | Preheating mode → Waiting mode → Heating mode |
| Heating mode | Heating mode |
| Fried food mode | Fried food mode |
| Water boiling mode | Water boiling mode |
| Rice cooking mode | Rice cooking mode |

The operation unit 4 is arranged on the front side (user side) of the display unit 12. The operation unit 4 includes a plurality of capacitance switches 4*a* to 4*f*. The user uses the switches 4*a* to 4*f* to give instructions about cooking. The switches 4*a* to 4*f* are arranged according to the number of heating portions 11.

Particular functions are respectively assigned to the switches 4*a* to 4*f*. For example, the switch 4*a* is an ON/OFF switch for controlling start and stop of cooking.

The switch 4*b* is a menu switch for switching the operation mode to either "preheating heating mode", "heating mode", "fried food mode", "water boiling mode", "rice cooking mode". Every time the user presses down the menu switch 4*b*, characters and pictures representing "heating", "preheating heating", "fried food", "water boiling", "rice cooking" blink in this order in the operation mode display unit 12*a*, so that the user switches the selection of the operation mode. When the user selects any one of the operations modes, i.e., "heating mode", "preheating heating mode", "fried food mode", "water boiling mode", "rice cooking mode", and manipulates the ON/OFF switch 4*a*, the selected operation mode is decided. Accordingly, an indication corresponding to the decided operation mode is lighted, and indications corresponding to the undecided operation modes are turned off.

The switch 4*c* is a heating power setting switch for increasing the heating power. The switch 4*d* is a heating power setting switch for decreasing the heating power. During operation in "heating mode" or "waiting mode", the heating power can be set by manipulating the heating power setting switches 4*c* and 4*d*.

The switches 4*e*, 4*f* are timer switches for setting a heating time.

When the control unit 8 detects that the switches 4*a* to 4*f* are pressed down, the control unit 8 controls the inverter circuit 7 based on the pressed switch, and controls the high frequency current provided to the heating coil 2.

Figure 3:
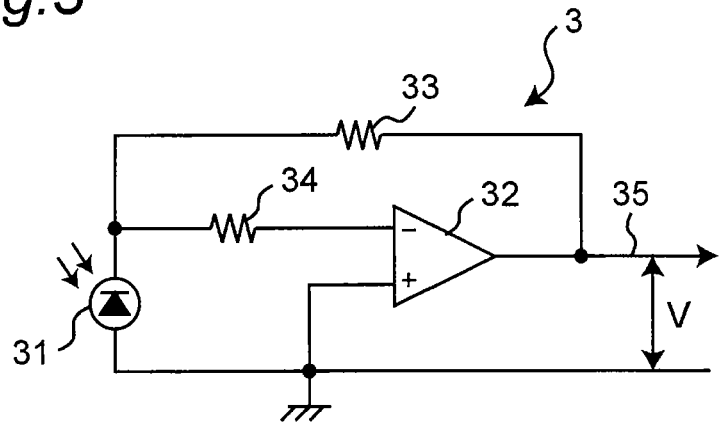
FIG. 3 is a circuit diagram illustrating an infrared sensor of FIG. 1.

FIG. 3 is a circuit diagram illustrating the infrared sensor 3. The infrared sensor 3 includes a photodiode 31, an operational amplifier 32, and resistors 33, 34. One end of the resistor 33 and one end of the resistor 34 are connected to the photodiode 31. The other end of the resistor 33 and the other end of the resistor 34 are respectively connected to the output terminal and the inverted output terminal of the operational amplifier 32. The photodiode 31 is a light receiving device made of silicon that conducts electric current when infrared light penetrating through the top plate 1, i.e., infrared light having a wavelength of approximately 3 micron or less, is emitted onto the photodiode 31. The photodiode 31 is arranged at such a position that the photodiode 31 can receive infrared light emitted from a cooking container. The electric current generated by the photodiode 31 is amplified by the operational amplifier 32, and is outputted to the control unit 8 as an infrared light detection signal 35 (corresponding to a voltage value V) representing the temperature of the object 10 to be heated. Since the infrared sensor 3 receives the infrared light emitted from the object 10 to be heated, the infrared sensor 3 has higher thermal responsiveness than a thermistor detecting the temperature via the top plate 1.

Figure 4:
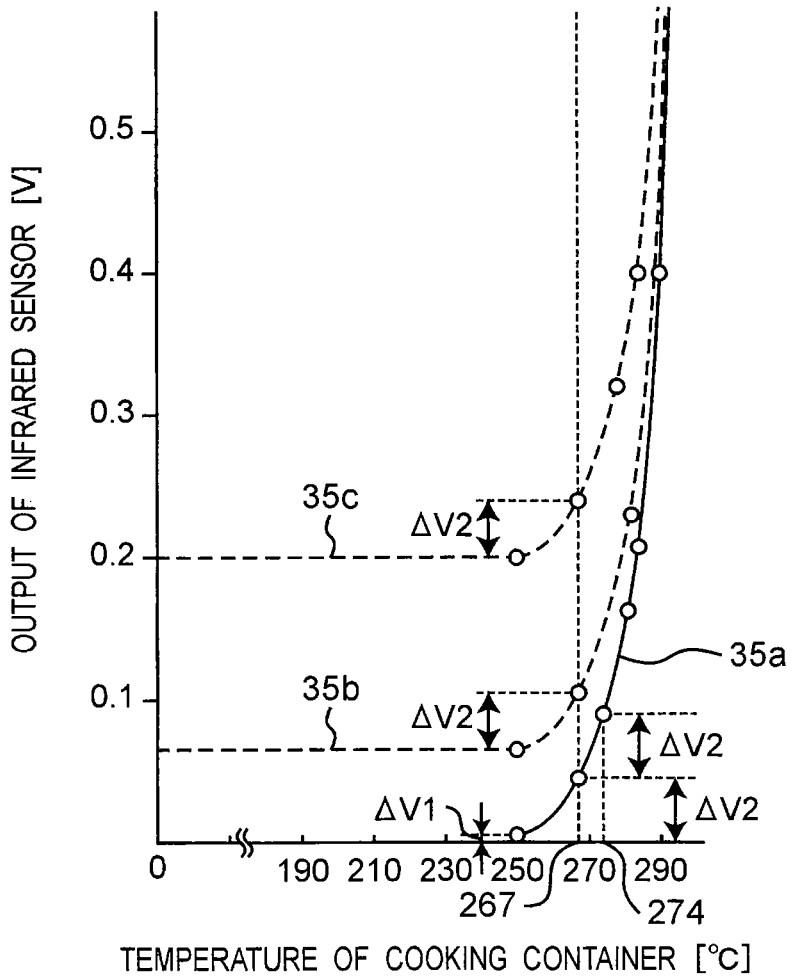
FIG. 4 is a diagram illustrating characteristics of the infrared sensor of FIG. 3.

FIG. 4 is output characteristics of the infrared sensor 3. In FIG. 4, the horizontal axis represents the temperature of the bottom surface of the object 10 to be heated such as a cooking container, and the vertical axis represents the voltage value of the infrared light detection signal 35 outputted from the infrared sensor 3. The infrared light detection signal 35 has output characteristics 35*a* to 35*c* based on the affect exerted by disturbance light. The output characteristic 35*a* represents the output of the infrared light detection signal 35 in a case where no disturbance light comes in, namely, in a case where only the infrared light emitted from the object 10 to be heated is received. The output characteristic 35*b* represents the output of the infrared light detection signal 35 in a case where weak disturbance light comes into the infrared sensor 3. The output characteristic 35*c* represents the output of the infrared light detection signal 35 in a case where intense disturbance light such as sunbeam comes in.

The present embodiment aims at performing preheating when high heating power is required, for example, when stir-fried food is cooked. Therefore, the preheating target temperature is high in the present embodiment (for example, 250° C. to 270° C.), and the output obtained at a high temperature is used. Accordingly, as shown by the output characteristics 35*a*, the infrared sensor 3 according to the present embodiment has characteristics that the infrared sensor 3 outputs the infrared light detection signal 35 when the temperature of the bottom surface of the object 10 to be heated is approximately 250° C. or more, but the infrared sensor 3 does not output the infrared light detection signal 35 when the temperature is less than approximately 250° C. In this case, "the infrared sensor 3 does not output the infrared light detection signal 35" means not only that "the infrared sensor 3 does not output the infrared light detection signal 35 at all", but also that "the infrared sensor 3 substantially does not output the infrared light detection signal 35", namely, "the infrared sensor 3 outputs a signal which is so weak that the control unit 8 is substantially unable to read the change of the temperature of the bottom surface of the object 10 to be heated based on the change of the magnitude of the infrared light detection signal 35". When the object 10 to be heated has a temperature within a range in which the signal is outputted, i.e., when the object 10 to be heated has a temperature of approximately 250° C. or more, the output value of the infrared light detection signal 35 has a monotonically increasing characteristic in nonlinear manner, and increases in an exponential function manner, in which the gradient of increase becomes steeper as the object 10 to be heated has a higher temperature.

In a case where the infrared sensor 3 receives weak disturbance light, the infrared sensor 3 outputs a signal having a small value due to the disturbance light as shown by the output characteristic 35*b* even when the temperature is less than 250° C. In a case where the infrared sensor 3 receives intense disturbance light such as sunbeam, the infrared sensor 3 outputs a signal having a large value as shown by the output characteristic 35*c* even when the temperature is less than 250° C.

Figure 7:
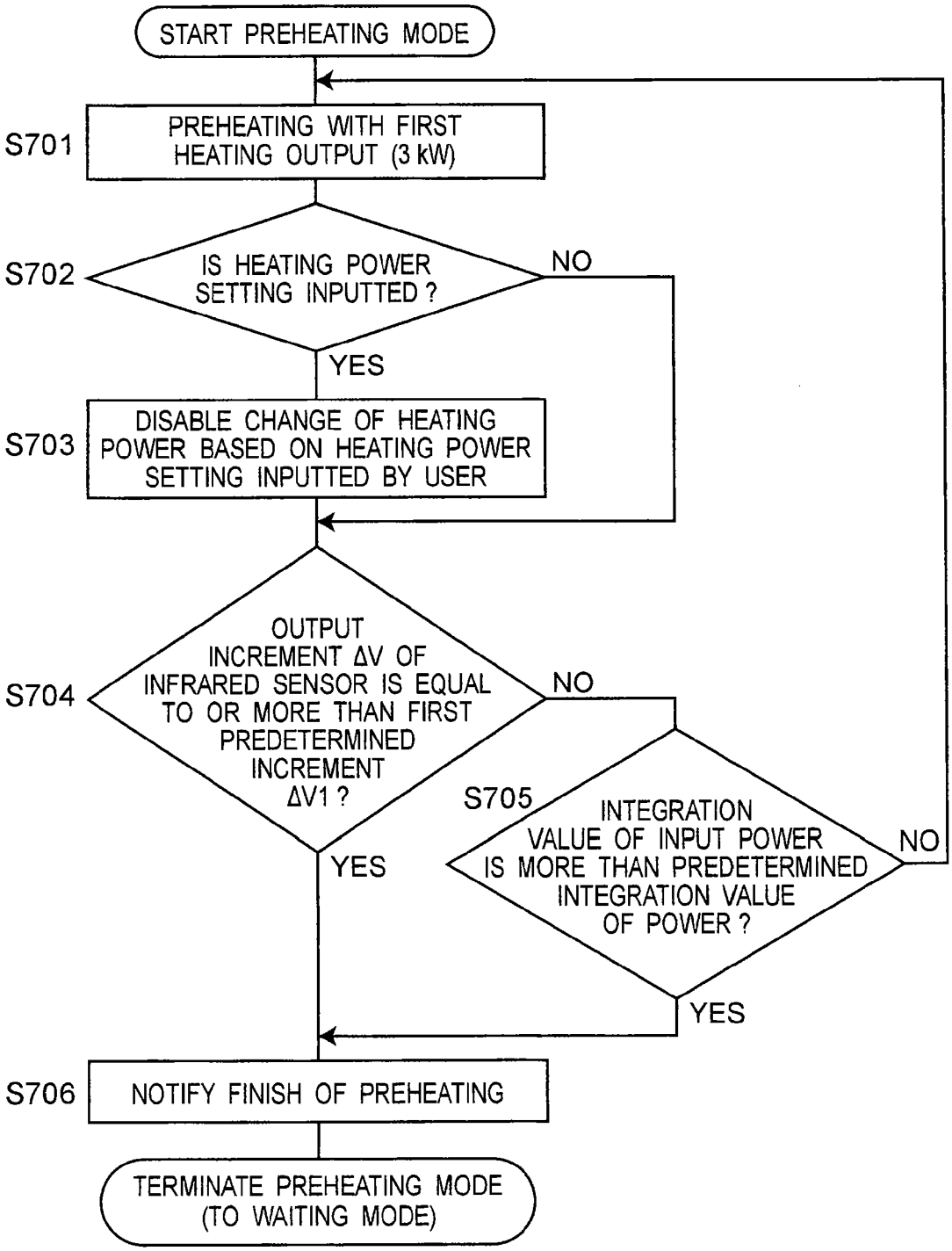
FIG. 7 is a flowchart illustrating the preheating mode.
Figure 8:
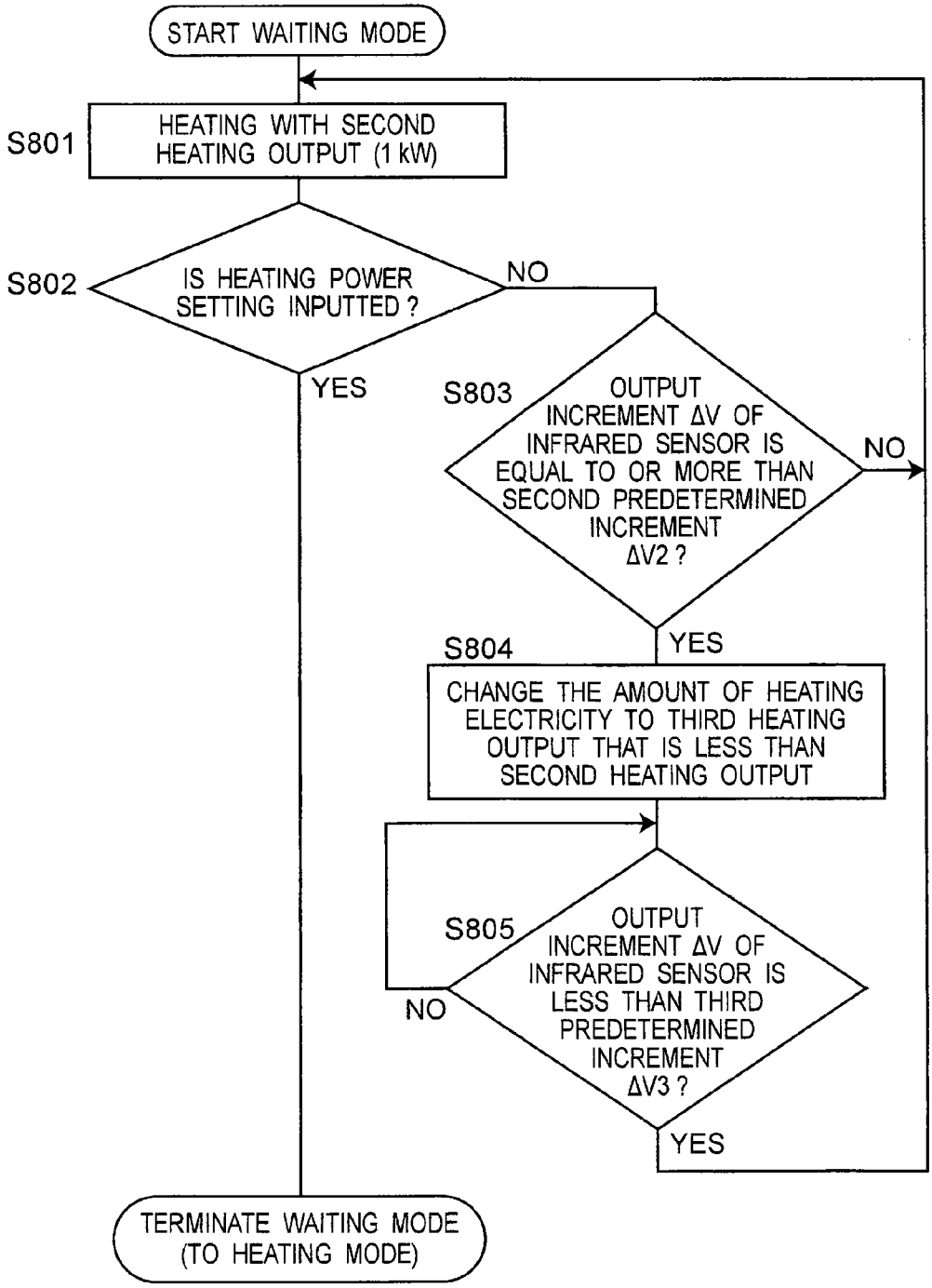
FIG. 8 is a flowchart illustrating the waiting mode.

As mentioned above, the infrared light detection signal 35 outputted by the infrared sensor 3 is affected by the disturbance light. In order to overcome this problem, in the present embodiment, the finish of preheating, i.e., whether the object 10 to be heated has reached the target temperature or not, is determined based on whether an output increment ΔV of the voltage value V of the infrared light detection signal 35 has exceeded a first predetermined increment ΔV1 since the preheating has started. The details of the predetermined increments ΔV1, ΔV2 of FIG. 4 will be described later when FIGS. 7, 8, 10 are described.

1.2 Operation of Induction Heat Cooking Device

Figure 5:
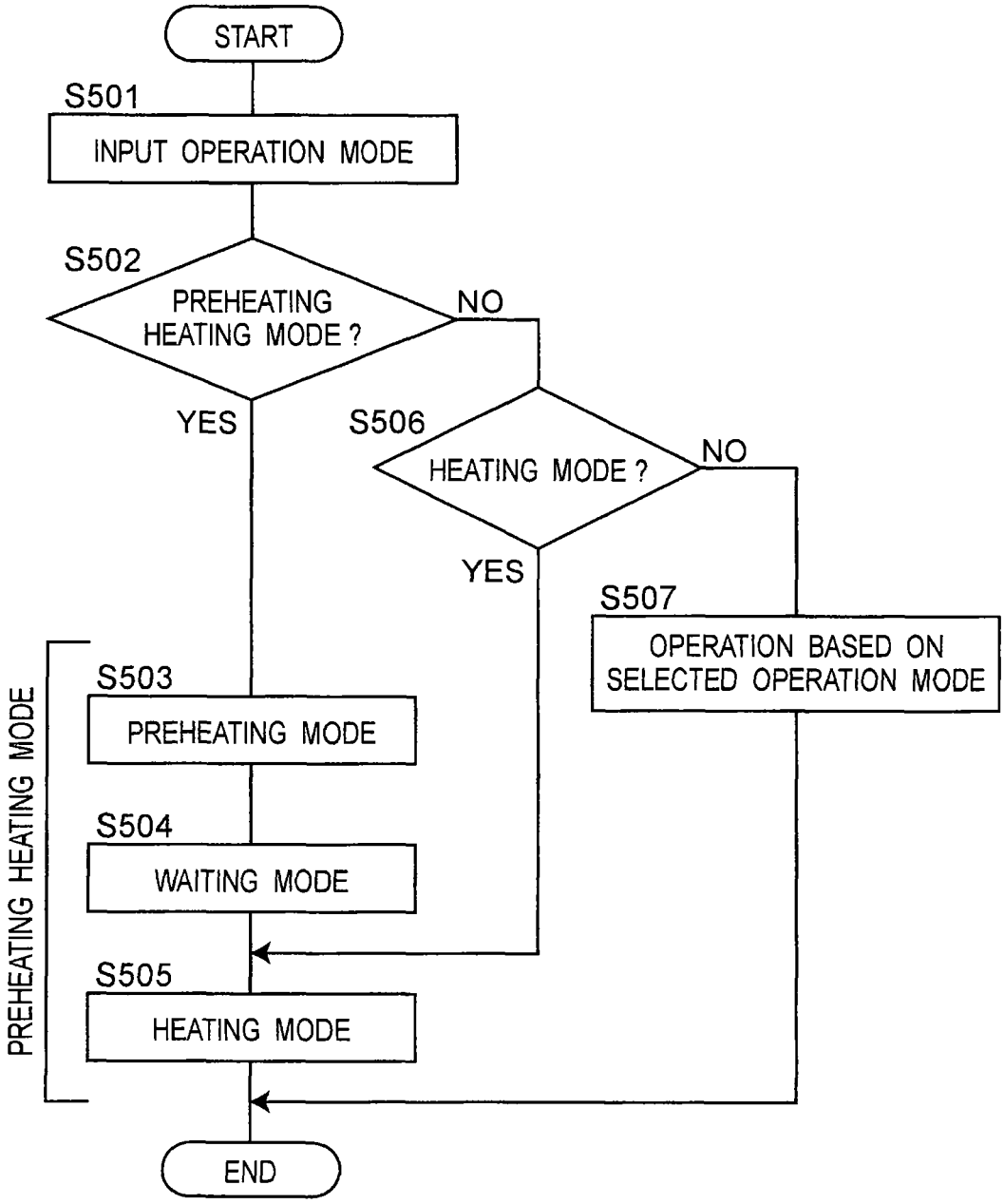
FIG. 5 is a flowchart illustrating overview of operation performed by the induction heat cooking device according to Embodiments 1 to 3 of the present invention.

Operation of the control unit 8 of the induction heat cooking device according to the present embodiment structured as described above will be hereinafter described. FIG. 5 schematically illustrates the operation of the induction heat cooking device according to the present embodiment. When the user turns on the power of the induction heat cooking device, the user manipulates the menu switch 4*b* to choose one of operation modes from among "preheating heating mode", "heating mode", "fried food mode", "water boiling mode", and "rice cooking mode", and subsequently, the user operates the ON/OFF switch 4*a* to decide the selected operation mode. The control unit 8 inputs the operation mode thus decided by the user via the operation unit 4 (S501). The control unit 8 determines whether the operation mode decided by the user is the preheating heating mode or not (S502). When the decided operation mode is determined to be the preheating heating mode (Yes in S502), the control unit 8 starts operation in the preheating mode (S503). In the preheating mode, the temperature of the cooking container is controlled so that the temperature reaches the predetermined target temperature (preheating temperature). When the temperature of the cooking container reaches the predetermined target temperature, and the preheating mode is finished, the control unit 8 starts operation in the waiting mode (S504). In the waiting mode, the temperature of the object 10 to be heated attained at the time of the finish of the preheating is controlled and maintained until the user sets the heating power. When the user sets the heating power in the waiting mode, the control unit 8 starts operation in the heating mode (S505). In the heating mode, the inverter circuit 7 is controlled based on the heating power set by the user. When the operation mode decided by the user is determined not to be the preheating heating mode (No in S502), the control unit 8 determines whether the operation mode decided by the user is the heating mode or not (S506). When the operation mode deiced by the user is determined to be the heating mode (Yes in S506), the control unit 8 starts operation in the heating mode without going into the preheating mode and the waiting mode (S505). When the operation mode decided by the user is determined not to be the heating mode (No in S506), the control unit 8 operates based on another operation mode that is selected and decided by the user (S507). For example, when the selected and decided operation mode is determined to be the fried food mode, the control unit 8 starts operation in the fried food mode. Since the present embodiment is characterized in "preheating heating mode", operation modes other than "preheating heating mode" will not be described in detail in the following description.

Figure 6A:
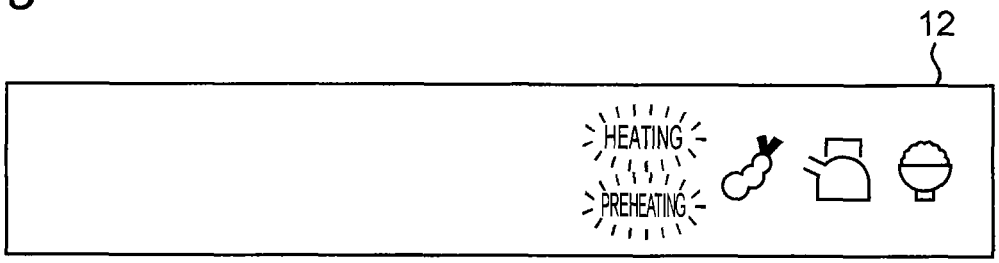
FIG. 6A is a view illustrating an example of display on a display unit when "preheating heating mode" is selected.
Figure 6B:
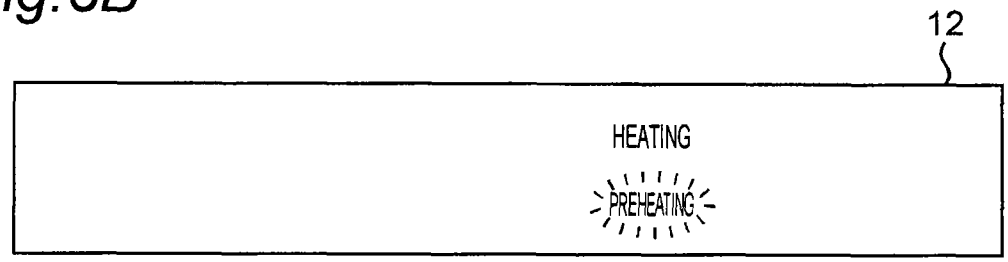
FIG. 6B is a view illustrating an example of display on a display unit in a preheating mode.
Figure 6C:
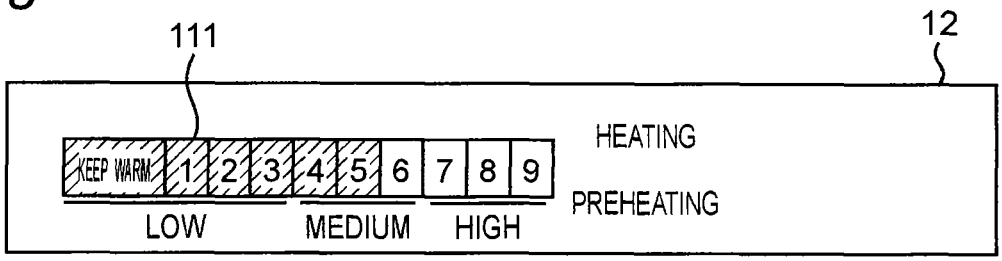
FIG. 6C is a view illustrating an example of display on a display unit in a waiting mode.
Figure 6D:
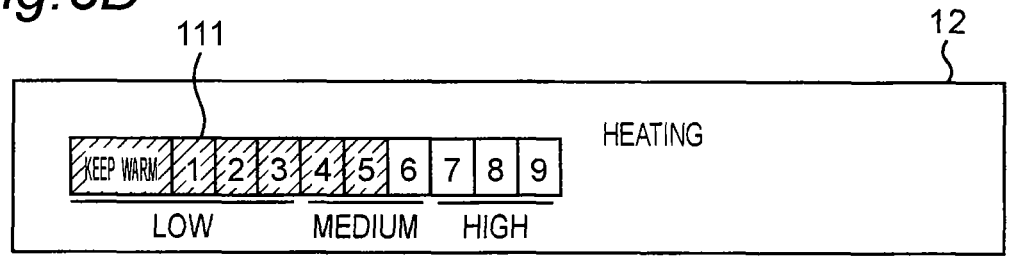
FIG. 6D is a view illustrating an example of display on a display unit in a heating mode.

FIGS. 6A to 6D illustrate examples of displays on the display unit 12 when the user selects and decides "preheating heating mode". More specifically, FIG. 6A illustrates an example of display when "preheating heating mode" is selected as the operation mode. FIG. 6B illustrates an example of display in the preheating mode. FIG. 6C illustrates an example of display in the waiting mode. FIG. 6D illustrates an example of display in the heating mode. When the user operates the menu switch 4*b*, and selects "preheating heating mode", characters of "heating" and "preheating" blink (FIG. 6A). When the user manipulates the ON/OFF switch 4*a* in this state, "preheating heating mode" is decided as the operation mode. In the preheating heating mode, the control unit 8 starts operation in the preheating mode, and the preheating starts. At this occasion, characters of "heating" are lighted, and characters of "preheating" are blinked (FIG. 6B). These characters indicate that heating is performed, and that the preheating function is operating. During preheating, even if the heating power setting switches 4*c*, 4*d* are manipulated, the control unit 8 disables the change of the heating power based on the manipulation. In order to allow the user to easily understand that the manipulation of the heating power setting switches 4*c*, 4*d* is disabled, the display unit 12 does not display a heating power bar 111 in the preheating mode.

When the preheating is finished, the operation mode is changed from the preheating mode to the waiting mode. In the waiting mode, the control unit 8 accepts the manipulation of the heating power setting switches 4*c*, 4*d* by the user. In the waiting mode, the characters of "preheating", which were blinking, are now lighting up, and the heating power bar 111 is displayed (FIG. 6C). At this occasion, the indication of the heating power bar 111 corresponds to the value of the heating power that is outputted when the preheating mode is finished. In FIG. 6C, the heating power is "5" when the preheating mode is finished. By displaying the heating power bar 111, the display unit 12 allows the user to understand that the manipulation of the heating power setting switches 4*c*, 4*d* is enabled. When the preheating mode is finished, and the operation mode is changed to the waiting mode, the control unit 8 enables the change of the heating power based on the manipulation of the heating power setting switches 4*c*, 4*d*. When the user sets the heating power in the waiting mode, the operation mode is changed to the heating mode. When the operation mode is changed to the heating mode, the characters of "preheating" are turned off, and only the characters of "heating" are lighted (FIG. 10(*d*)).

FIG. 7 illustrates the flow corresponding to the preheating mode (S503) of FIG. 5. In the preheating mode, the control unit 8 starts preheating with a predetermined amount of heating electricity (first heating output, for example, 3 kW) (S701). In the preheating mode, the control unit 8 controls so that the temperature of the cooking container attains a predetermined target temperature (for example, 250° C. to 270° C.). The control unit 8 determines whether the heating power setting switches 4*c*, 4*d* are manipulated or not (S702). When the heating power setting switches 4*c*, 4*d* are manipulated in the preheating mode (Yes in S702), the control unit 8 disables the change of the heating power based on the manipulation (S703). The control unit 8 determines whether the output increment ΔV of the infrared sensor has attained a value equal to or more than the first predetermined increment ΔV1 since the heating has been started (S704). When the output increment ΔV of the infrared sensor attains a value equal to or more than the first predetermined increment ΔV1 (Yes in S704), the control unit 8 determines that the object 10 to be heated has attained the target temperature of the preheating, and notifies the finish of the preheating by causing the notification unit 13 to output a beep sound for notifying the finish of the preheating (S706). The control unit 8 terminates the preheating mode, and goes into the waiting mode.

In a case where the object 10 to be heated is a cooking container made of glossy metal such as aluminum, the emissivity of infrared light is extremely low. As a result, even when the temperature of the object 10 to be heated increases, the output increment ΔV of the infrared sensor does not immediately increase. In order to overcome this problem, the present embodiment is configured such that the preheating is finished based on the integration value of the input power from the start of the preheating, so that the preheating can be finished accurately even when the object 10 to be heated is a metal pot. When the output increment ΔV of the infrared sensor is determined to be less than the first predetermined increment ΔV1 (No in S704), the control unit 8 determines whether the integration value of the input power from the start of the preheating has exceeded a predetermined value (S705). When the integration value of the input power is determined to have exceeded the predetermined value (Yes in S705), the finish of the preheating is notified (S706). When the integration value of the input power is determined not to have exceeded the predetermined value, the flow is returned to step S701.

FIG. 8 illustrates the flow corresponding to the waiting mode (S504) of FIG. 5. In the waiting mode, the control unit 8 controls such that the temperature of the cooking container is maintained at the temperature obtained at the finish of the preheating (for example approximately 250° C.). When the operation mode is changed to the waiting mode, the display unit 12 displays the heating power bar 111 in order to allow the user to easily understand that the manipulation of the heating power setting switches 4*c*, 4*d* is enabled (FIG. 6C). When the operation mode is changed to the waiting mode, the control unit 8 performs heating with an amount of heating electricity (second heating output, for example, 1 kW) that is smaller than the amount of heating electricity in the preheating mode (S801). In the waiting mode, the control unit 8 determines whether the heating power setting switches 4*c*, 4*d* have been manipulated or not (S802). When the heating power setting switches 4*c*, 4*d* are determined not to have been manipulated (No in S802), the control unit 8 determines whether the output increment ΔV of the infrared sensor 3 is equal to or more than a second predetermined increment ΔV2 that is larger than the first predetermined increment ΔV1 (S803). When the output increment ΔV of the infrared sensor 3 is determined to be equal to or more than the second predetermined increment ΔV2 (Yes in S803), the amount of heating electricity is changed to a value (third heating output, for example, 0 kW) smaller than the second heating output (S804).

The control unit 8 determines whether the output increment ΔV of the infrared sensor 3 is less than a third predetermined increment ΔV3 that is equal to or less than the second predetermined increment ΔV2 (S805). When the output increment ΔV of the infrared sensor 3 is determined to be less than the third predetermined increment ΔV3 (Yes in S805), the amount of heating electricity is returned back to the second heating output (S801). When the output increment ΔV of the infrared sensor 3 is determined not to be less than the third predetermined increment ΔV3 (No in S805), the heating continues with the third heating output.

When the heating power setting switches 4*c*, 4*d* are manipulated in the waiting mode (Yes in S802), the waiting mode is terminated, and the operation mode is changed to the heating mode.

Figure 9:
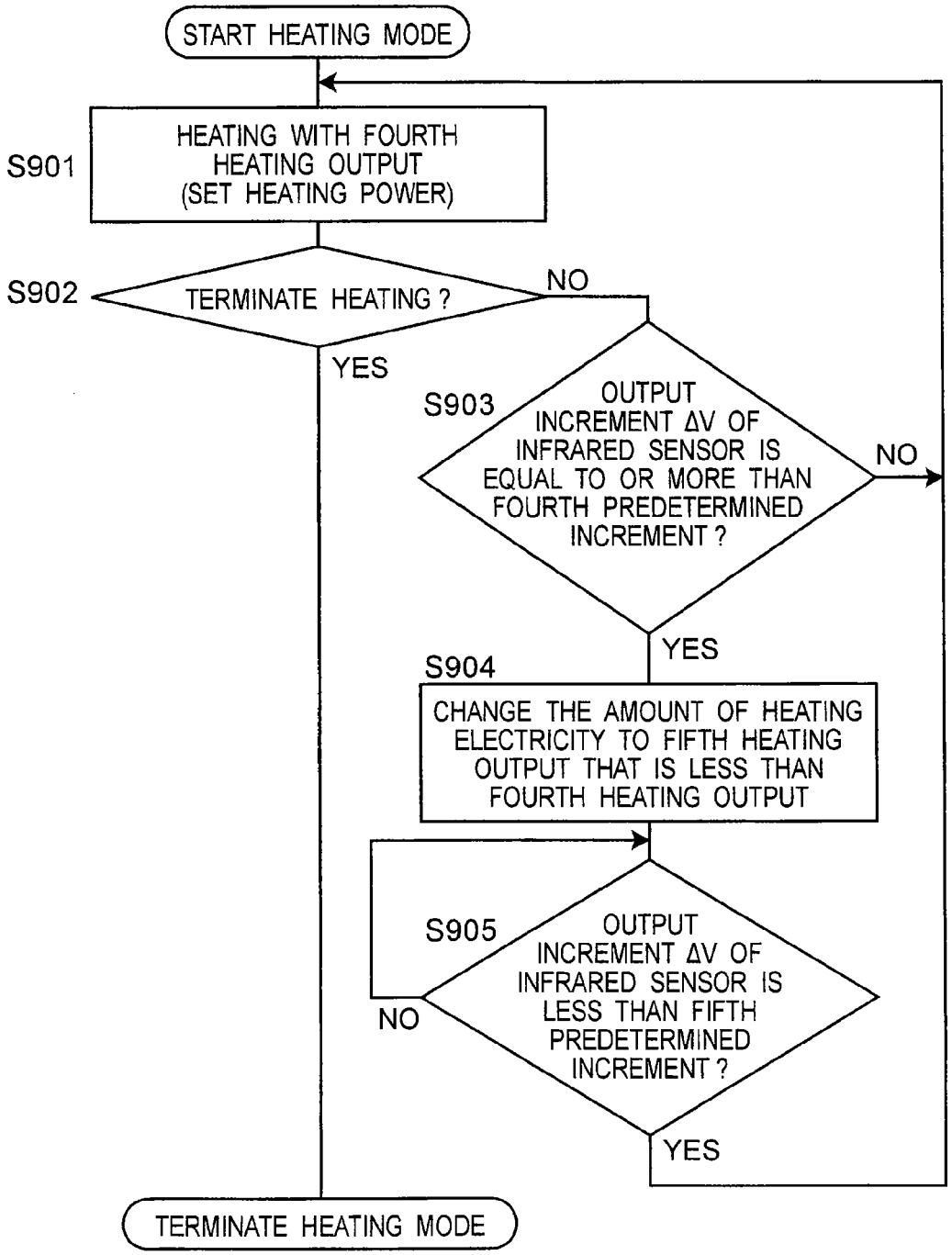
FIG. 9 is a flowchart illustrating the heating mode.

FIG. 9 illustrates the flow corresponding to the heating mode (S505) of FIG. 5. In the heating mode, the control unit 8 controls so as to maintain the temperature according to the heating power set by the user. In the heating mode, the control unit 8 starts heating with the amount of heating electricity (fourth heating output) according to the heating power set by the user (S901). The control unit 8 determines whether the user has manipulated the ON/OFF switch 4*a* to give an instruction for terminating the heating (S902). When the user has not given an instruction for terminating the heating (No in S902), the control unit 8 determines whether the output increment ΔV of the infrared sensor 3 has attained a value equal to or more than a fourth predetermined increment ΔV4 (S903). When the output increment ΔV of the infrared sensor 3 has attained a value equal to or more than the fourth predetermined increment ΔV4 (Yes in S903), the control unit 8 changes the amount of heating electricity to a fifth heating output (for example, 0 kW) that is smaller than the fourth heating output (S904).

The control unit 8 determines whether the output increment ΔV of the infrared sensor 3 has attained a value less than a fifth predetermined increment ΔV5 that is equal to or less than the fourth predetermined increment ΔV4 (S905). When the output increment ΔV of the infrared sensor 3 attains a value less than the fifth predetermined increment ΔV5 (Yes in S905), the control unit 8 changes the amount of heating electricity back to the fourth heating output (S901). When the output increment ΔV of the infrared sensor 3 is determined not to be less than the fifth predetermined increment ΔV5 (No in S905), the heating continues with the fifth heating output. When an instruction for terminating the heating is given in the heating mode (Yes in S902), the heating is terminated.

Figure 10A:
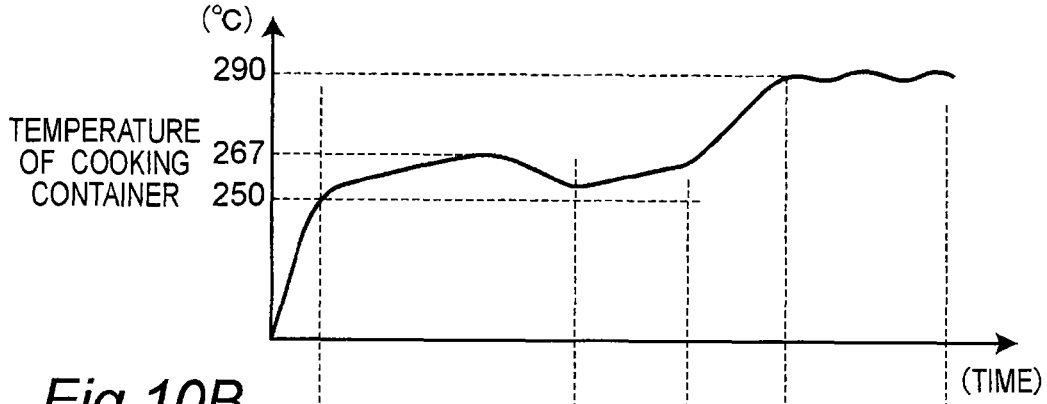
FIG. 10A is a view illustrating a temperature of a cooking container.
Figure 10B:
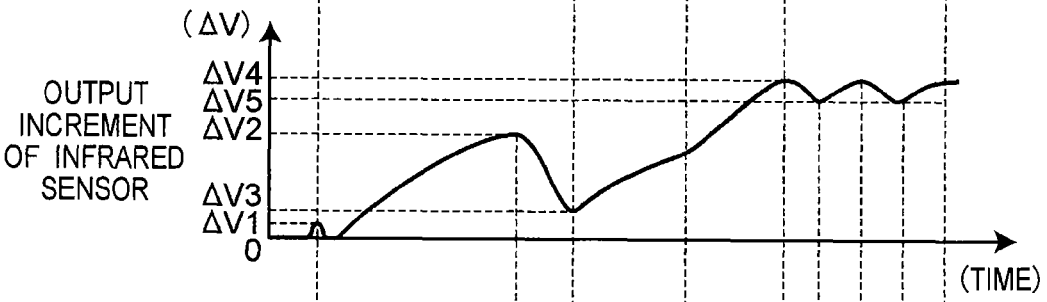
FIG. 10B is a view illustrating the output increment of the infrared sensor.
Figure 10C:
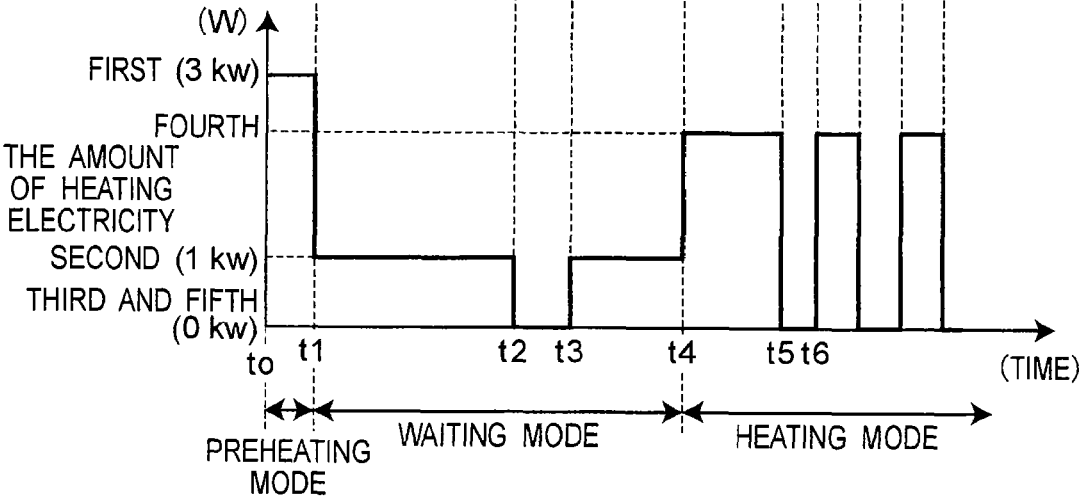
FIG. 10C is a view illustrating the amount of heating electricity.

FIGS. 10A, 10B, and 10C respectively illustrate examples of the temperature of the cooking container (° C.), the output increment (ΔV) of the infrared sensor 3, and the amount of heating electricity (W) in "preheating mode", "waiting mode", and "heating mode" respectively shown in FIGS. 7 to 9. In FIGS. 10A, 10B, and 10C, the horizontal axis represents time. In FIG. 10B, the first to the fifth output increments ΔV1 to ΔV5 represent the output increment ΔV of the infrared sensor 3 since the preheating has been started.

At a time t0, the user selects and decides "preheating heating mode", and the operation starts in preheating mode. In the preheating mode, the control unit 8 starts the preheating with the first heating output (for example, 3 kW). The preheating continues with the first heating output until the output increment ΔV of the infrared sensor 3 reaches the first predetermined increment ΔV1. At a time t1, the output increment ΔV of the infrared sensor 3 reaches the first predetermined increment ΔV1. The control unit 8 determines that the object 10 to be heated has attained the target temperature of the preheating, and changes the operation mode to the waiting mode.

In the waiting mode, the control unit 8 starts the heating with the second heating output (for example, 1 kW) that is smaller than the output in the preheating mode (time t1 to time t2). When the amount of heating electricity is reduced, the distribution of the temperature of the object 10 to be heated is averaged. Accordingly, at the time t1, the output of the infrared sensor 3 temporarily decreases. It should be noted that the infrared sensor 3 is arranged at such position that the infrared sensor 3 can detect the approximate maximum temperature of the bottom surface of the object 10 to be heated. Thereafter, the output of the infrared sensor 3 increases again. At the time t2, the output increment ΔV of the infrared sensor 3 reaches the second predetermined increment ΔV2 that is larger than the first predetermined increment ΔV1. The control unit 8 changes the amount of heating electricity to the third heating output (for example, 0 kW) that is smaller than the second heating output. At a time t3, the output increment ΔV of the infrared sensor 3 attains a value less than the third predetermined increment ΔV3 that is equal to or less than the second predetermined increment ΔV2. The control unit 8 changes the amount of heating electricity back to the second heating output (for example, 1 kW).

As described above, in the waiting mode, the following operations are repeatedly performed: when the output increment ΔV of the infrared sensor 3 attains a value equal to or more than the second predetermined increment ΔV2, the amount of heating electricity is reduced to the third heating output (for example, 0 kW), and when the output increment ΔV of the infrared sensor 3 attains a value less than the third predetermined increment ΔV3, the amount of heating electricity is returned back to the second heating output (for example, 1 kW). By repeating the above operations, the temperature of the object 10 to be heated in the waiting mode is maintained within a temperature range suitable for the preheating, i.e., the temperature of the object 10 to be heated does not become less than the temperature obtained at the finish of the preheating (for example, approximately 250° C.).

As described above, because the temperature of the object 10 to be heated is detected based on the output increment ΔV of the infrared sensor 3 since the start of the heating, the detected temperature is less likely to be affected by static disturbance light. Further, because the temperature of the object 10 to be heated is detected based on the output increment ΔV of the infrared sensor 3 since the start of the heating, the detected temperature is not largely affected by the temperature of the object 10 to be heated at the start of the heating. Accordingly, the preheating can be finished within a temperature range that can be tolerated from a practical point of view, and the temperature of the object 10 to be heated can be maintained at an appropriate temperature after the preheating has been finished. In other words, in a case where the temperature of the object 10 to be heated at the start of the heating is such a temperature that the output of the infrared sensor 3 can be detected, the gradient of the increasing output of the infrared sensor 3 becomes steeper as the temperature of the object 10 to be heated increases, even when the temperature is higher than approximately 250° C. in FIG. 4, for example. Further, the magnitude of the output value rapidly increases (in an exponential function manner). Therefore, the difference of the temperature of the object 10 to be heated at the time of detecting the finish of the preheating due to the difference of the temperature of the object 10 to be heated at the start of the heating can be reduced to a value that can be tolerated from the practical point of view. For example, when the temperature of the cooking container at the start of the heating is 267° C., the first predetermined increment ΔV1 is reached immediately after the start of the heating, and the preheating is finished. Thereafter, the temperature is maintained so that the temperature does not exceed 274° C. (corresponding to ΔV2) (see FIG. 4). This temperature at the finish of the preheating (approximately 267° C.) and the maximum value in the waiting mode (274° C.) can be tolerated from the practical point of view.

When the user manipulates the heating power setting switches 4*c*, 4*d* at the time t4, the control unit 8 changes the operation mode to the heating mode, and starts the heating with the fourth heating output according to the set heating power. The value of the fourth predetermined increment ΔV4 and the value of the fifth predetermined increment ΔV5, which is less than the fourth predetermined increment ΔV4, are determined based on the set fourth heating output. For example, when the set fourth heating output is determined to be larger than the second heating output, the fourth predetermined increment ΔV4 is set to a value larger than the second predetermined increment ΔV2. On the other hand, for example, when the set fourth heating output is determined to be less than the second heating output, the fourth predetermined increment ΔV4 is set to the same value as the first predetermined increment ΔV1.

At a time t5, the output increment ΔV of the infrared sensor 3 reaches the fourth predetermined increment ΔV4. The control unit 8 reduces the amount of heating electricity to the fifth heating output (for example, 0 kW) that is smaller than the fourth heating output. At a time t6, the output increment ΔV of the infrared sensor 3 attains a value less than a fifth predetermined increment ΔV5 that is equal to or less than the fourth predetermined increment ΔV4. The control unit 8 changes the amount of heating electricity back to the fourth heating output.

As described above, in the heating mode, the following operations are repeatedly performed: when the output increment ΔV of the infrared sensor 3 attains a value equal to or more than the fourth predetermined increment ΔV4, the amount of heating electricity is reduced to the fifth heating output (for example, 0 kW), and when the output increment ΔV of the infrared sensor 3 attains a value less than the fifth predetermined increment ΔV5, the amount of heating electricity is returned back to the fourth heating output. By repeating the above operations, the object 10 to be heated is maintained at the temperature according to the set heating power in the heating mode. In the heating mode, after the start of the heating, the temperature of the object 10 to be heated is detected based on the output increment ΔV of the infrared sensor 3 in the same manner as the temperature of the heated object is detected based on the second predetermined increment ΔV2 as described above, and the effects obtained from this configuration are also the same. The fourth predetermined increment ΔV4 is set to the increment of the voltage outputted by the infrared sensor 3 from when the heating starts to when the temperature of the portion of the heated object measured by the infrared sensor 3 attains, for example, approximately 290° C. Therefore, the temperature is prevented from exceeding the firing temperature of the small amount of oil contained in the heated object.

1.3 Summary

In the induction heat cooking device according to the present embodiment, the infrared sensor 3 having high thermal responsiveness detects the temperature of the object 10 to be heated. Accordingly, the actual temperature of the object 10 to be heated can be accurately detected. For example, when the bottom surface of the cooking container is warped or the bottom surface of the cooking container is thin, the actual temperature of the object 10 to be heated can be accurately detected without delay in time. Therefore, even when the preheating starts with high heating power (first heating output, for example, 3 kW), the temperature of the object 10 to be heated does not greatly exceed the target temperature, the infrared sensor 3 can immediately detect that the temperature of the object 10 to be heated has reached the target temperature. As a result, the preheating can start with high heating power, and the target temperature can be reached in a short time. Thus, the preheating can be finished in a short time before the heating, even when stir-fried food is cooked, in which cooking starts with a small amount of oil but with high heating power.

Further, the finish of the preheating is accurately performed, and the heating power is reduced right after the operation mode is changed to the waiting mode. Accordingly, the temperature of the object 10 to be heated does not greatly exceed the preheating target temperature after the preheating is finished. Therefore, the object 10 to be heated such as a frying pan can be prevented from reaching an excessively high temperature and deforming or getting discolored.

Still further, in the waiting mode, the heating is performed while the heating power is reduced to the second heating output, and when the output increment ΔV of the infrared sensor 3 attains a value less than the third predetermined increment ΔV3 that is equal to or less than the second predetermined increment ΔV2, the third heating output (for example, 0 kW) is changed back to the second heating output (for example, 1 kW). In other words, the control is performed such that even when the temperature changes after the preheating is finished, the infrared sensor 3 immediately detects the change, and immediately brings the temperature back to the temperature obtained upon the finish of the preheating. Therefore, in a short time, the temperature can be stabilized to the temperature obtained upon the finish of the preheating. In other words, in the waiting mode, it is possible to maintain the temperature obtained upon the finish of the preheating. Accordingly, for example, even after many foods are put into the cooking container in the waiting mode, and the temperature of the cooking container decreases, the temperature can be immediately brought back to the temperature obtained upon the finish of the preheating. Therefore, foods in the cooking container can be sufficiently heated. In addition, efficient heating can be achieved when the operation mode is changed from the waiting mode to the heating mode.

Still further, the temperature obtained upon the finish of the preheating can be maintained. Therefore, the object 10 to be heated can be prevented from being excessively heated. For example, even when a small amount of oil in a pot is heated, the temperature of the pot does not increase rapidly in the waiting mode. Therefore, safe induction heat cooking device can be provided.

In the preheating mode, the setting of the heating power is disabled, and the control is performed so that an appropriate temperature is automatically attained. Accordingly, the preheating is not performed at a temperature that is different from the target temperature of the preheating. Further, after the finish of the preheating is notified, the setting of the heating power is enabled. Therefore, the user can start cooking with the foods kept at an appropriate temperature. In addition, after the preheating is finished, the user can optionally change the heating power according to the foods.

In the preheating, the heating power bar 111 is hidden, which enables the user to easily, visually understand that the heating power cannot be changed. Moreover, after the preheating is finished, the heating power bar 111 is displayed, which enables the user to visually understand that the preheating is finished and that the setting of the heating can be performed. Therefore, the operability is improved.

On the operation mode display unit 12*a*, the characters of "heating" and the characters of "preheating" are turned on, blinked, or turned off. Accordingly, the user can easily, visually understand the mode in which the operation is currently performed. Therefore, the operability is improved. For example, in the preheating mode, the characters of "heating" are turned on, and the characters of "preheating" are blinked, so that the user is notified that the preheating operation is performed. After the preheating is finished, the character of "preheating" is switched from blinking to continuous lighting, so that the user is notified that the preheating is finished and that the temperature is maintained. When the operation mode is changed from the waiting mode to the heating mode, the characters of "preheating" are turned off, and only the characters of "heating" are lighted, so that the user is notified that the waiting mode is terminated and that the operation mode is changed to the heating mode.

The light receiving device of the infrared sensor 3 employs the photodiode 31 made of silicon. Therefore, the infrared sensor 3 is inexpensive.

The infrared sensor 3 is arranged at a position in the radius direction of the coiled wire of the heating coil 2, i.e., at a position between the outer coil 2*a* and the inner coil 2*b*, so that the infrared sensor 3 measures the portion of the bottom surface of the object 10 to be heated located above the position between the coiled wires of the outer coil 2*a* and the inner coil 2*b*, at which the heating coil 2 generates the most intense high frequency magnetic field. Accordingly, the infrared sensor 3 can measure the high temperature close to the highest temperature of the object 10 to be heated. Therefore, while the infrared sensor 3 has high detection sensitivity with respect to the high temperature portion of the object 10 to be heated, the power supply to the heating coil 2 can be controlled. Therefore, excessive heating can be prevented.

Further, the preheating control is performed based on the output increment ΔV of the infrared sensor 3. Therefore, the preheating can be performed without being affected by disturbance noise such as light.

Still further, the preheating is finished based on not only the output increment of the infrared sensor 3 but also the integration value of the input power. Therefore, even when a cooking container has extremely low emissivity, excessive heating can be prevented, and appropriate preheating control can be performed.

According to the present embodiment, there are operation modes including "heating mode" for going into "heating mode" without performing preheating and "preheating heating mode" for performing preheating before performing heating. Accordingly, the user can select whether preheating is performed or not. Therefore, the operability can be further improved.

1.4 Modification

When the degree of adverse effect exerted on the infrared sensor 3 by disturbance light can be sufficiently reduced by improving or adding an optical filter and a light shielding structure, the operation mode may be changed to the waiting mode based on the increment of the output value of the infrared sensor 3 with respect to a predetermined initial output value, instead of the increment ΔV of the output value of the infrared sensor 3 from when the heating starts with the first heating output. For example, the predetermined initial output value may be obtained as follows: the cooking container 10 having a low temperature (for example, 35° C. or less) at which the gradient of increase in the output of the infrared sensor 3 with respect to the change of the temperature of the bottom surface of the cooking container 10 is approximate zero or equal to or less than a predetermined value is placed on the top plate 1, and an output value of the infrared sensor 3 (predetermined initial output value) is measured and stored in advance while the cooking container 10 covers the infrared sensor 3. The predetermined initial output value may be, for example, an increment ΔV of the output value of the infrared sensor 3 with respect to the above output value of the infrared sensor 3 (predetermined initial output value). In other words, the predetermined initial output value may be about the same value as the output value of the infrared sensor 3 that is obtained when the cooking container 10 having a low temperature at which the gradient of increase in the output of the infrared sensor 3 with respect to the change of the temperature of the cooking container 10 is equal to or less than a predetermined value is placed on the top plate 1. In another example, the output value of the infrared sensor may be measured when an object having about the same emissivity as others is used as the cooking container 10 to prevent visible light from entering into the infrared sensor 3. It may be an output value of the infrared sensor 3 under the condition where the infrared sensor 3 does not output the value corresponding to the amount of received light. In this case, the first predetermined increment ΔV1 to the fifth predetermined increment ΔV5 represents the increments ΔV of the output values of the infrared sensor 3 with respect to the predetermined initial output value. The control unit 8 stores the predetermined initial output value to a storage unit (not shown) of the control unit 8, and calculates the difference between the output value of the infrared sensor 3 and the predetermined initial output value, thus easily calculating the increment ΔV of the output value of the infrared sensor 3.

In Embodiment 1, the increment ΔV of the output value of the infrared sensor 3 is the increment of the output value of the infrared sensor 3 with respect to the start of the heating. In this case, when the temperature of the cooking container 10 is high at the start of the heating, the infrared sensor 3 has high output sensitivity. Accordingly, as the temperature comes close to the target temperature, the temperature of which output is actually suppressed and controlled becomes higher than the target temperature. As a result, the error with respect to the target temperature increases. As described above, however, the increment ΔV of the output value of the infrared sensor 3 is the increment of the output value of the infrared sensor 3 with respect to the output value of the infrared sensor 3 that is measured and stored in advance at such a temperature at which the gradient of increase in the output of the infrared sensor 3 with respect to the change of the temperature of the bottom surface of the cooking container 10 is approximate zero or equal to or less than a predetermined value. Therefore, the error is prevented from increasing when the temperature is controlled and adjusted to the target temperature of the cooking container 10.

The first predetermined increment ΔV1 to the fifth predetermined increment ΔV5 may be changed according to the material and the emissivity of the object 10 to be heated. Therefore, appropriate temperature control can be achieved.

In the present embodiment, the waiting mode is a mode for maintaining the temperature obtained at the finish of the preheating. Alternatively, the temperature maintained in the waiting mode may be a predetermined appropriate temperature that is less than the temperature obtained at the finish of the preheating. In this case, the second predetermined increment ΔV2 may be set within the range equal to or less than the first predetermined increment ΔV1.

When the object 10 to be heated is maintained at a high temperature for a long period, the bottom surface of the object 10 to be heated may be discolored. In order to cope with such case, the second heating output may be reduced to, for example, approximately 500 W after the preheating is finished. In this case, after the preheating is finished, the temperature may not return back to the temperature obtained at the finish of the preheating (for example, 180° C. to 200° C.). In this case, however, this preheating process can still serve as the preheating function. Accordingly, the second heating output may be set appropriately.

It should be noted that the fourth predetermined increment ΔV4 and the fifth predetermined increment ΔV5 equal to or less than the fourth predetermined increment ΔV4 may be decided regardless of the magnitude of the set fourth heating output. In this case, the fourth predetermined increment ΔV4 is also set larger than the second predetermined increment ΔV2. When the set fourth heating output is larger than the second heating output, the fourth predetermined increment ΔV4 is set larger than the second predetermined increment ΔV2, and as the set fourth heating output becomes larger, the fourth predetermined increment ΔV4 may be set smaller. When the fourth heating output is extremely large, the heated object is prevented from reaching an excessively high temperature by increasing the responsiveness in the temperature suppression.

When the preheating mode is terminated, and the operation mode is changed to the waiting mode, the characters of "preheating" may be turned off.

The notification unit 13 may be a speaker for outputting voice guide, LEDs, a liquid crystal, and the like.

In the present embodiment, the infrared sensor 3 outputs the infrared light detection signal 35 when the temperature is approximately 250° C. or more. However, this value is not limited to approximately 250° C. For example, this value may be a temperature less than or higher than 250° C. However, in order to make the infrared sensor 3 inexpensively and in view of variation of the circuit of the control unit 8, the output of the infrared light detection signal 35 preferably starts when the temperature is within the range between 240° C. and 260° C.

The light receiving device of the infrared sensor 3 may be other types of photodiodes and phototransistors, and the infrared sensor 3 may be a quantum infrared sensor. In addition, the infrared sensor 3 may be not only the quantum infrared sensor but also other types of infrared sensors such as a thermopile.

Embodiment 2

In the description of Embodiment 2, the first predetermined increment ΔV1 is set according to the material of the object 10 to be heated. In a case where the cooking container is made of glossy metal such as aluminum, the emissivity of infrared light is extremely low. As a result, even when the temperature of the object 10 to be heated increases, the output increment ΔV of the infrared sensor does not immediately increase. In order to overcome this problem, the present embodiment is configured such that even when the object 10 to be heated is a metal pot, the first predetermined increment ΔV1 is set according to whether the cooking container is made of aluminum or not, so that the preheating can be finished more accurately.

2.1 Structure of Induction Heat Cooking Device

Figure 11:
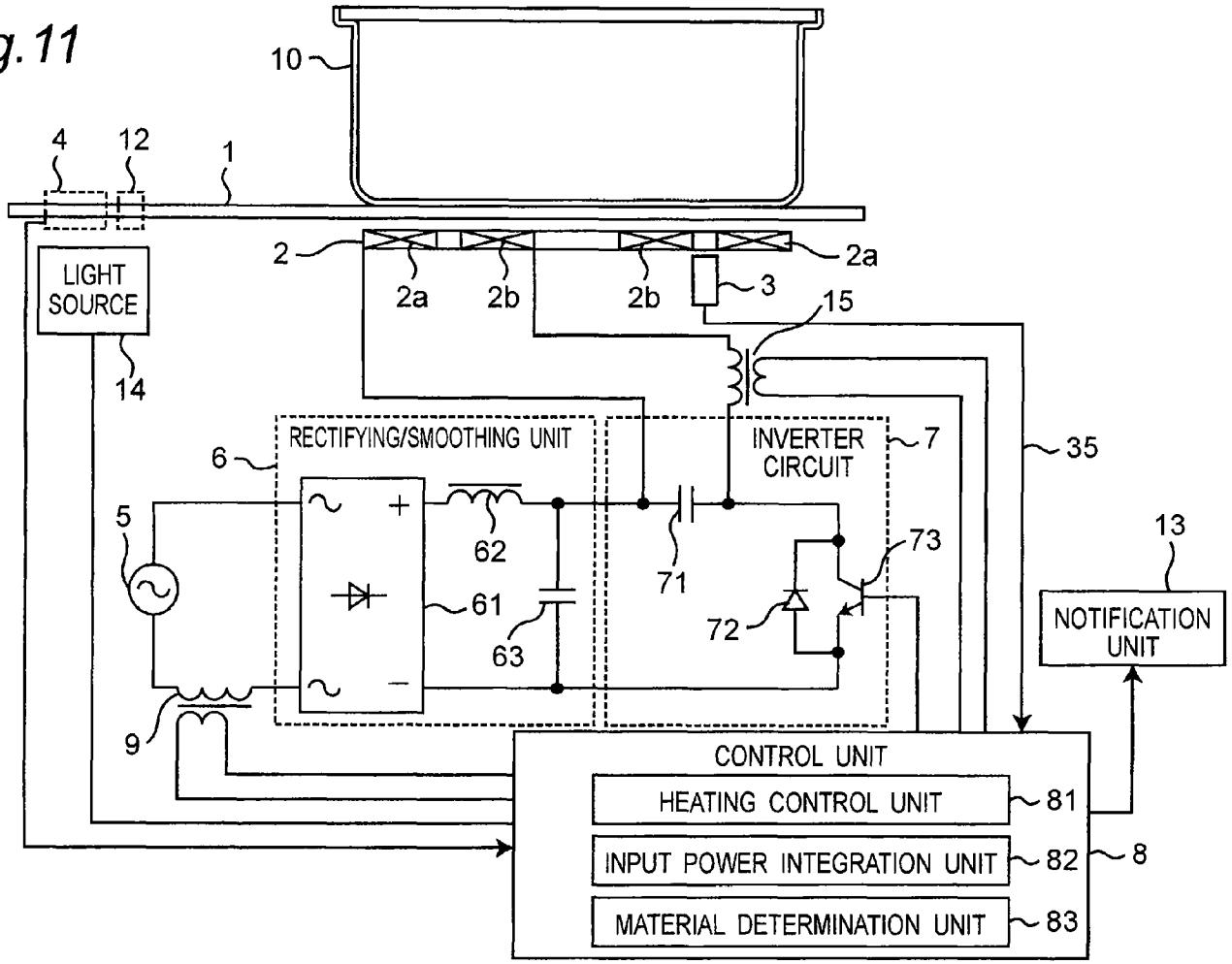
FIG. 11 is a block diagram illustrating a structure of an induction heat cooking device according to Embodiment 2 of the present invention.

FIG. 11 illustrates a structure of an induction heat cooking device according to Embodiment 2 of the present invention. The induction heat cooking device according to the present embodiment includes not only the elements of FIG. 1 but also a heating coil current detection unit 15 for detecting the magnitude of the current flowing in the heating coil 2 (hereinafter referred to as "heating coil current"). The heating coil current detection unit 15 is a current transformer, and monitors the heating coil current by magnetically coupling with the heating coil 2. In the present embodiment, the control unit 8 further includes a material determination unit 83 for comparing the magnitude of the input current detected by the input current detection unit 9 and the magnitude of the heating coil current detected by the heating coil current detection unit 15 and determining the material of the cooking container based on the ratio between the input current and the heating coil current.

2.2 Operation of Induction Heat Cooking Device

Figure 12:
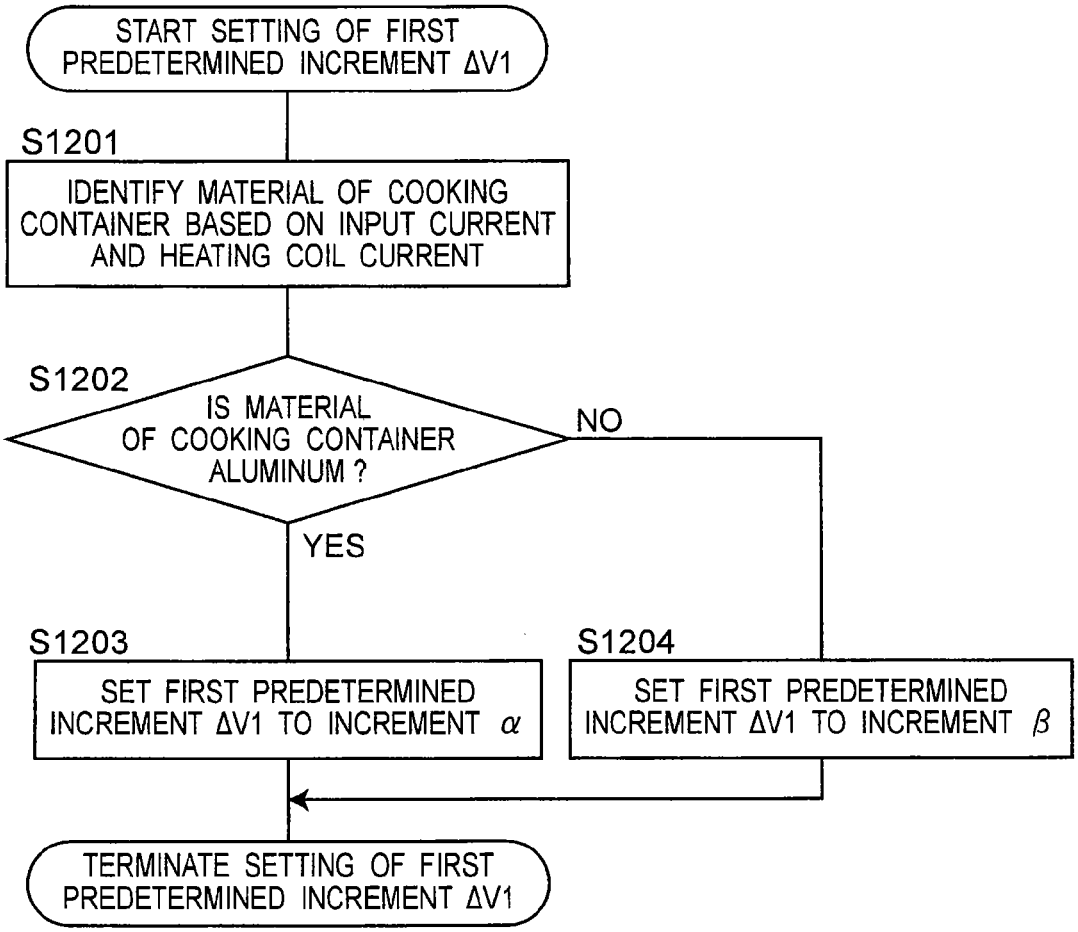
FIG. 12 is a flowchart illustrating a setting of a first predetermined increment ΔV1 in the preheating mode in the induction heat cooking device of FIG. 11.

FIG. 12 illustrates a flowchart for setting the first predetermined increment ΔV1. The flow shown in FIG. 12 is performed before step S704 in the flow of the preheating mode shown in FIG. 7. When the preheating mode starts, the input current detection unit 9 detects the magnitude of the input current flowing from the commercial power source 5 into the rectifying/smoothing unit 6. The heating coil current detection unit 15 detects a heating coil current flowing in the heating coil 2 when the switching device 73 is conducting, and also detects the magnitude of a heating coil current that is a resonant current flowing in a resonant capacitor 71 and the heating coil 2 when the switching device 73 is switched-off. The material determination unit 83 compares the magnitude of the detected input current and the magnitude of the detected heating coil current, and identifies the material of the cooking container (S1201). More specifically, the material determination unit 83 determines whether the material of the cooking container is aluminum or other material.

When the value of the heating coil current is compared with the value of the input current, and the cooking container made of aluminum is heated, the hating coil current has a larger value, compared with a case where other metal materials such as iron and stainless are heated. Therefore, it can be determined whether the cooking container is made of aluminum or not based on the detected input current and the detected heating coil current. The heating control unit 81 determines whether the material of the cooking container identified by the material determination unit 83 is aluminum or not (S1202). When the material is determined to be aluminum, the first predetermined increment ΔV1 is set to an increment α (S1203). When the material is determined not to be aluminum, the first predetermined increment ΔV1 is set to an increment β (S1204). It should be noted that α is less than β.

The first predetermined increment ΔV1 thus set is used in step S704 of FIG. 7, and is compared with the output increment ΔV of the infrared sensor 3.

2.3. Summary

The emissivity of infrared light emitted from the cooking container made of aluminum is smaller than the emissivity of infrared light emitted from other metal materials such as iron. When the radiant quantity is the same, the temperature of the cooking container made of aluminum is higher than the temperature of the cooking container made of other metal materials. Accordingly, when the first predetermined increment ΔV1 is kept constant, and the material of the cooking container is aluminum, the cooking container may be excessively heated. Therefore, the present embodiment is configured such that the material of the cooking container is determined, and when the determined material is aluminum, the first predetermined increment ΔV1 is set smaller, compared with a case where the determined material is other metal materials such as iron. As a result, even when the cooking container is made of aluminum, excessive heating can be prevented, the cooking container is prevented from reaching an excessively high temperature. In other words, as shown in FIG. 7, the preheating is finished based on the integration value of the input power since the start of the preheating (Yes in S705), so that the preheating can be accurately finished even when the object 10 to be heated is a metal pot, which is safe. Further, the present embodiment is configured such that the first predetermined increment ΔV1 for a cooking container having high emissivity is set lower than the first predetermined increment ΔV1 for a cooking container having low emissivity based on the material of the cooking container. Therefore, the preheating mode can be finished with high accuracy, and the heating can be performed more safely and efficiently. According to the present embodiment, even when the material of the cooking container is aluminum, the temperature of the bottom surface of the cooking container can be detected accurately and immediately. As soon as the temperature of the bottom surface reaches a predetermined temperature, the temperature is maintained by limiting the heating power immediately. Therefore, the safety can be improved, and efficient heating can be achieved. As described above, even when the tendency of increase in the temperature of the bottom surface is different, the temperature control can be performed according to the material of the cooking container, and as soon as the temperature of the bottom surface reaches a predetermined temperature, the temperature is maintained by limiting the heating power. Therefore, the performance of cooking and the safety can be improved, and efficient heating can be achieved.

In the present embodiment, the first predetermined increment ΔV1 is changed according to whether the material is aluminum or not (for example, whether aluminum or iron). Likewise, this can also be applied to other materials. According to the emissivities of materials, the first predetermined increment ΔV1 may be changed such that the first predetermined increment ΔV1 for a material having high emissivity may be set smaller than the first predetermined increment ΔV1 for a material having low emissivity. In such case, similar effects can be obtained.

It should be noted that the increments α, β set as the first predetermined increment ΔV1 may be changed. Accordingly, even when the material of the cooking container to be heated and the degree of warpage of the bottom surface of the cooking container are beyond the scope of assumption, appropriate temperature control can be performed. In addition, the safety can be improved, and efficient heating can be achieved.

2.4 Modification

Figure 13:
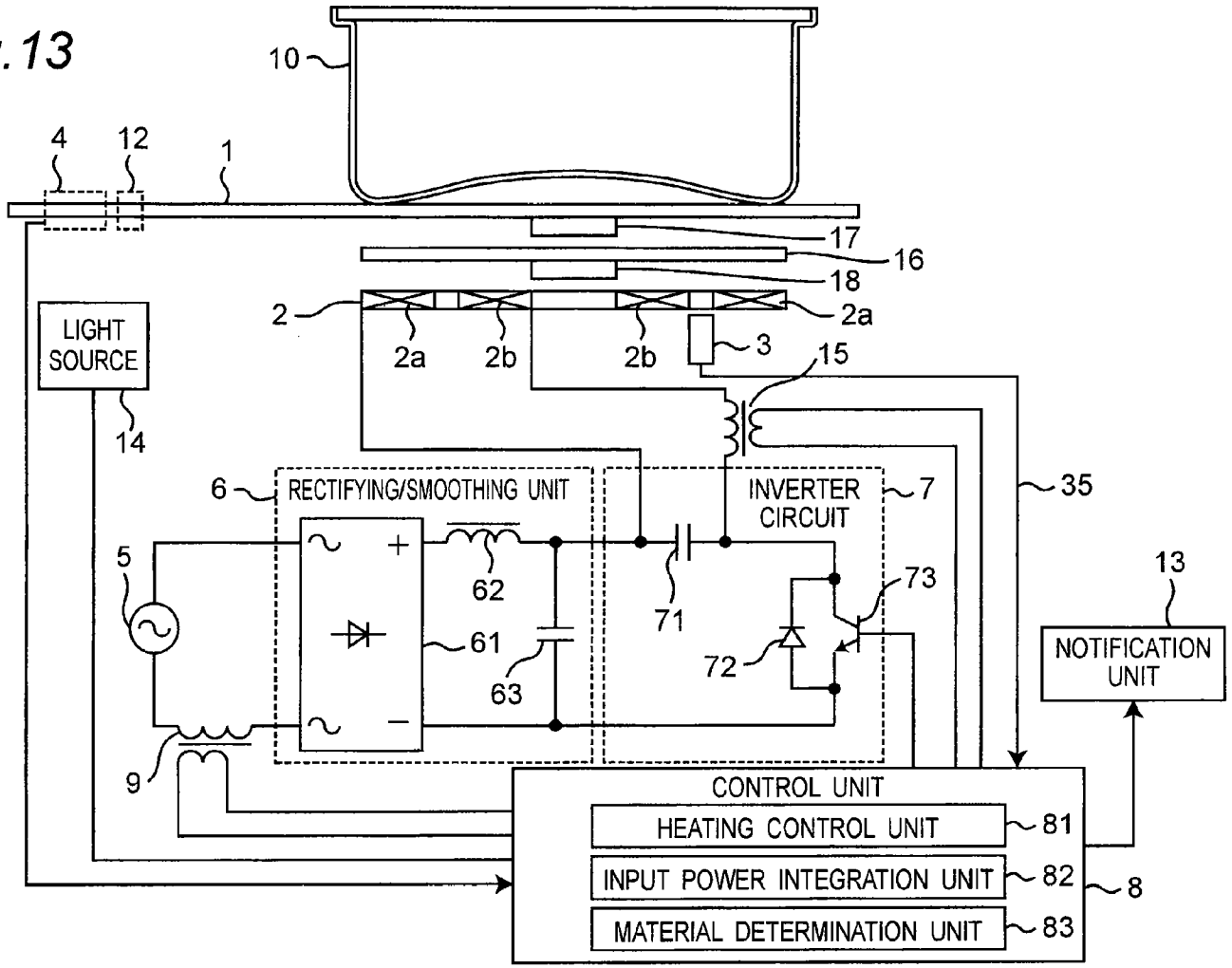
FIG. 13 is a block diagram illustrating another structure of the induction heat cooking device according to Embodiment 2 of the present invention.
Figure 14:
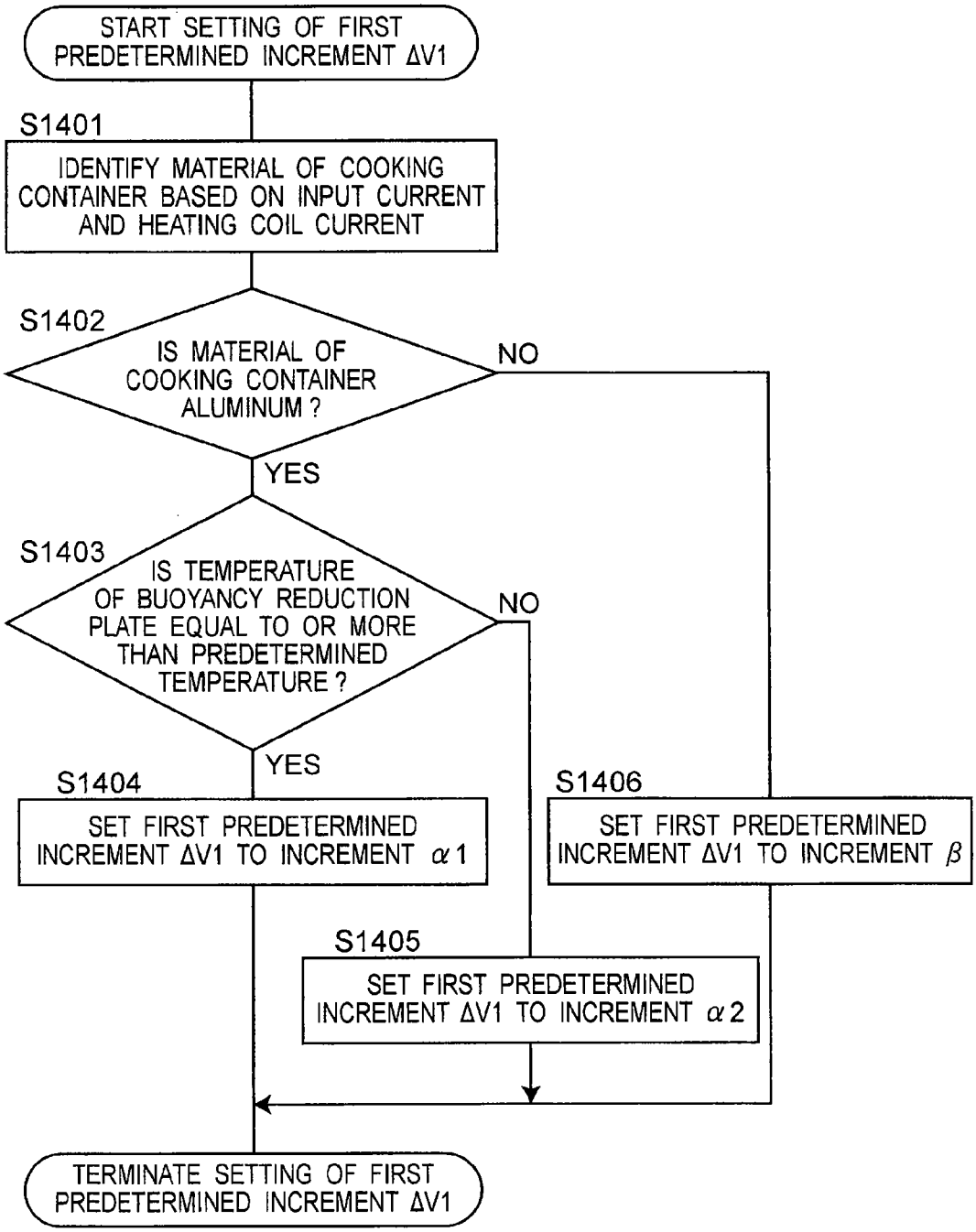
FIG. 14 is a flowchart illustrating a setting of the first predetermined increment ΔV1 in the preheating mode in the induction heat cooking device of FIG. 13.

FIG. 13 illustrates an induction heat cooking device having a buoyancy reduction plate for reducing buoyancy exerted on a cooking container. The induction heat cooking device shown in FIG. 13 includes not only the structure shown in FIG. 11 but also a buoyancy reduction plate 16 arranged between the top plate 1 and the heating coil 2 and a first temperature detection unit 18 (for example, thermistor) for detecting the temperature of the buoyancy reduction plate 16. In a case where the material of the cooking container is aluminum, buoyancy occurs. Accordingly, as shown in FIG. 13, the buoyancy reduction plate 16 (for example, an electrically conductive plate such as aluminum having a thickness of 0.5 to 1.5 mm) for reducing the buoyancy exerted on the cooking container may be arranged between the top plate 1 and the heating coil 2. The buoyancy reduction plate 16 is formed in an annular shape when it is seen from above, and is arranged to cover the heating coil 2. By increasing equivalent series resistors of the heating coil 2, the current flowing in the heating coil 2 that is needed to obtain a desired heating output is reduced, and the buoyancy exerted on the cooking container can be reduced. It should be noted that the buoyancy reduction plate 16 may be divided and arranged. When the buoyancy reduction plate 16 is arranged between the top plate 1 and the heating coil 2, the buoyancy reduction plate 16 reaches a high temperature due to the heat applied by the heating coil 2. In this case, the infrared light emitted by the buoyancy reduction plate 16 may be reflected in the top plate 1, and may enter into the infrared sensor 3. In addition, the top plate 1 may reach a high temperature, and the infrared light emitted by the top plate 1 may enter into the infrared sensor 3. In other words, since the infrared sensor 3 detects a high temperature of the buoyancy reduction plate 16, the infrared sensor 3 cannot accurately detect the temperature of the bottom surface of the cooking container. In order to overcome this problem, the first predetermined increment ΔV1 is changed based on whether the buoyancy reduction plate 16 has a high temperature equal to or more than a predetermined temperature (for example, 350° C. or more) in this example. FIG. 14 illustrates operation for setting the first predetermined increment ΔV1 in the induction heat cooking device of FIG. 13. Steps S1401, S1402, S1406 of FIG. 14 are the same as steps S1201, S1202, S1204 of FIG. 12, respectively, and the description thereabout is omitted. In FIG. 14, when the material of the cooking container is determined to be aluminum (S1402), the control unit 8 determines whether the temperature of the buoyancy reduction plate 16 detected by the first temperature detection unit 18 is equal to or more than the predetermined temperature (for example, 350° C.) (S1403). When the temperature is determined to be equal to or more than the predetermined temperature, the control unit 8 determines that the buoyancy reduction plate 16 is at a high temperature, and sets the first predetermined increment ΔV1 to the increment α1 (S1404). When the temperature is determined not to be equal to or more than the predetermined temperature, the control unit 8 determines that the buoyancy reduction plate 16 is not at a high temperature, and sets the first predetermined increment ΔV1 to the increment α2. It should be noted that α1 is less than α2. When the buoyancy reduction plate 16 is at a high temperature equal to or more than a predetermined temperature, the first predetermined increment ΔV1 is set smaller, compared with a case where it is less than the predetermined temperature. Therefore, even when the tendency of increase in the temperature of the bottom surface of the cooking container upon the start of the heating is affected by the temperature of the buoyancy reduction plate at the start of the heating, the increase in the temperature of the bottom surface of the cooking container can be accurately detected, and the temperature of the cooking container is prevented from increasing excessively. Thus, the safety can be improved.

As shown by the object 10 to be heated in FIG. 13, the bottom surface of the cooking container may be warped to the inside (concave warpage) when the cooking container is made of aluminum. In this case, the infrared sensor 3 cannot accurately detect the temperature of the bottom surface of the cooking container. In order to overcome this problem, the first predetermined increment ΔV1 may be changed based on whether the bottom surface of the cooking container is warped or not. In this case, as shown in FIG. 13, a second temperature detection unit 17 (for example, thermistor) is further arranged to detect the temperature of the top plate 1. The second temperature detection unit 17 is arranged at a position corresponding to a central section of the heating coil 2, and the second temperature detection unit 17 detects the temperature of the top plate 1. In this case, the induction heat cooking device also operates according to the flow of FIG. 14. However, instead of the processing of step S1403 of FIG. 14, the control unit 8 determines whether the bottom surface of the cooking container made of aluminum is warped or not, based on a determination as to whether a different between the temperature of the top plate 1 detected by the first temperature detection unit 18 and the temperature of the buoyancy reduction plate 16 detected by the second temperature detection unit 17 is equal to or less than the predetermined temperature (for example, 50° C.) after a predetermined time (for example, 10 seconds) passes since the start of the heating. When the temperature difference is determined to be equal to or less than the predetermined temperature, the control unit 8 determines that the bottom surface of the cooking container is warped, and the first predetermined increment ΔV1 is set to increment α1 (S1404). When the temperature difference is determined not to be equal to or less than the predetermined temperature, the control unit 8 determines that the bottom surface of the cooking container is not warped, and the first predetermined increment ΔV1 is set to increment α2 (S1405). It should be noted that $\alpha 1<\alpha 2<\beta$ holds. When the buoyancy reduction plate is heated by induction due to the warped bottom surface of the cooking container made of aluminum at the start of the preheating mode, and the buoyancy reduction plate reaches a high temperature, the infrared sensor 3 cannot accurately detect the temperature of the bottom surface of the cooking container. Even in such case, it is possible to accurately detect that the temperature of the bottom surface of the cooking container has reached a predetermined temperature, because the first predetermined increment ΔV1 is set based on whether there is warpage or not. Therefore, the cooking container is prevented from reaching an excessively high temperature, and the performance of cooking can be improved. In addition, safe and efficient heating can be achieved.

It should be noted that the predetermined electric power integration value in S705 of FIG. 7 may be changed according to the material of the cooking container. In a case of a cooking container made of aluminum having high thermal conductivity and low thermal efficiency, the heat is likely to be released. Accordingly, the temperature of the cooking container with respect to the integration value of input is lower than the temperature of a cooking container made of other materials. Therefore, the predetermined electric power integration value for aluminum is preferably set larger than the predetermined electric power integration value for materials other than aluminum (that is, the predetermined electric power integration value for aluminum P1 is more than the predetermined electric power integration value for materials other than aluminum P2). As a result, even when a cooking container having extremely low emissivity is heated, appropriate temperature control can be performed, and even when the input power varies due to the material of the cooking container, highly accurate temperature control can be achieved. It should be noted that the predetermined electric power integration values P1, P2 may be changeable. Accordingly, even when the magnitude of the input power is beyond the scope of assumption due to the material of the cooking container, appropriate temperature control can be achieved, and efficient heating can be achieved. Further, the predetermined electric power integration value in S705 of FIG. 7 may be set based on whether the buoyancy reduction plate 16 is at a high temperature or not or based on whether the bottom surface of cooking container is warped or not.

The heating coil current detection unit 15 can detect the magnitude of the heating coil current. For example, the heating coil current detection unit 15 can detect a voltage or a current in proportional to the magnitude of the heating coil current, such as the voltage of the resonant capacitor 71 and the voltage or the current of the switching device 73. In Embodiments 1 and 2, the input current detection unit 9 is a current transformer, but is not limited thereto. For example, a shunt resistor having a very small resistance of 0.1 to 10 milliohms may be connected to the input current path, and the magnitude of the input current may be measured based on the voltage drop thereof. Further, the material determination unit 83 is not limited to the above configuration. The material determination unit 83 can be anything as long as it can determine the material of the cooking container.

As described above, the induction heat cooking device according to the present embodiment can properly detect the temperature of the cooking container, and can maintain the temperature of the cooking container at an appropriate temperature, without being affected by the difference in emissivity of the infrared light due to the material of the cooking container, the temperature of the buoyancy reduction plate at the start of the heating, or the warpage of the bottom surface of the cooking container. Accordingly, the excessive temperature increase can be prevented. Therefore, the induction heat cooking device according to the present embodiment is useful for an induction heat cooking device used in ordinary households and commercial-use kitchens.

Embodiment 3

In the description of Embodiment 3, an induction heat cooking device can perform heating without causing problems in a cooking container. When a cooking container is heated for a long time, the cooking container is discolored or deteriorated (for example, deterioration of coated fluorine resin). In order to solve this problem, when the switch is not manipulated for a long time, for example, when the user does not cook or forgets to turn off the switch, the heating is halted in Embodiment 3. More specifically, in the waiting mode, when a predetermined time passes without the switch being manipulated by the user, the heating is halted. Therefore, the cooking container is prevented from being discolored and damaged.

Figure 15:
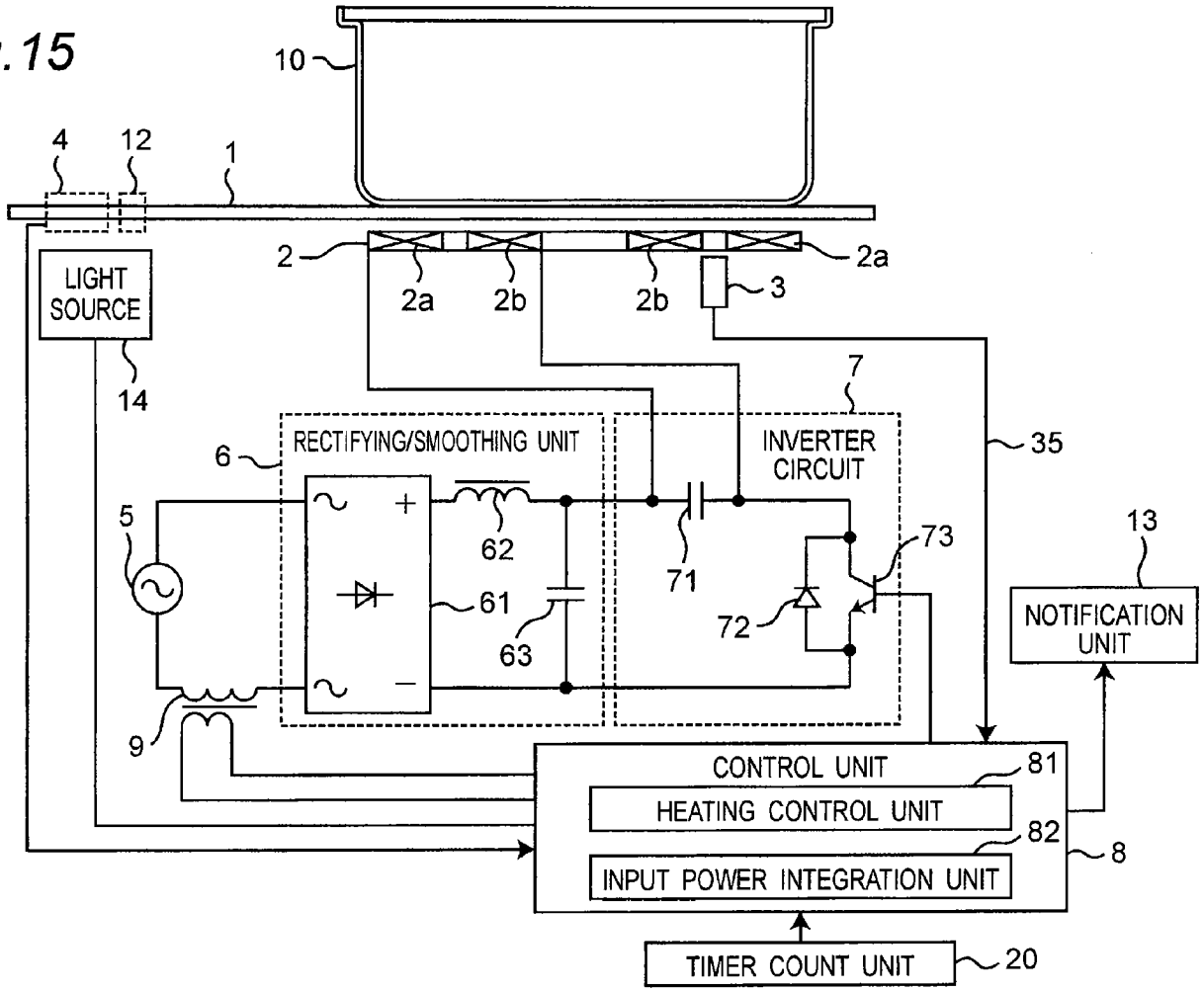
FIG. 15 is a block diagram illustrating a structure of an induction heat cooking device according to Embodiment 3 of the present invention.

FIG. 15 illustrates a structure of an induction heat cooking device according to Embodiment 3 of the present invention. The induction heat cooking device according to the present embodiment includes not only the structure of FIG. 1 but also a timer count unit 20. The timer count unit 20 measures an elapsed time from when operation started in the waiting mode (hereinafter referred to as a "timer time"). When the timer time reaches a first predetermined time, the timer count unit 20 transmits a heating stop signal to the control unit 8.

Figure 16:
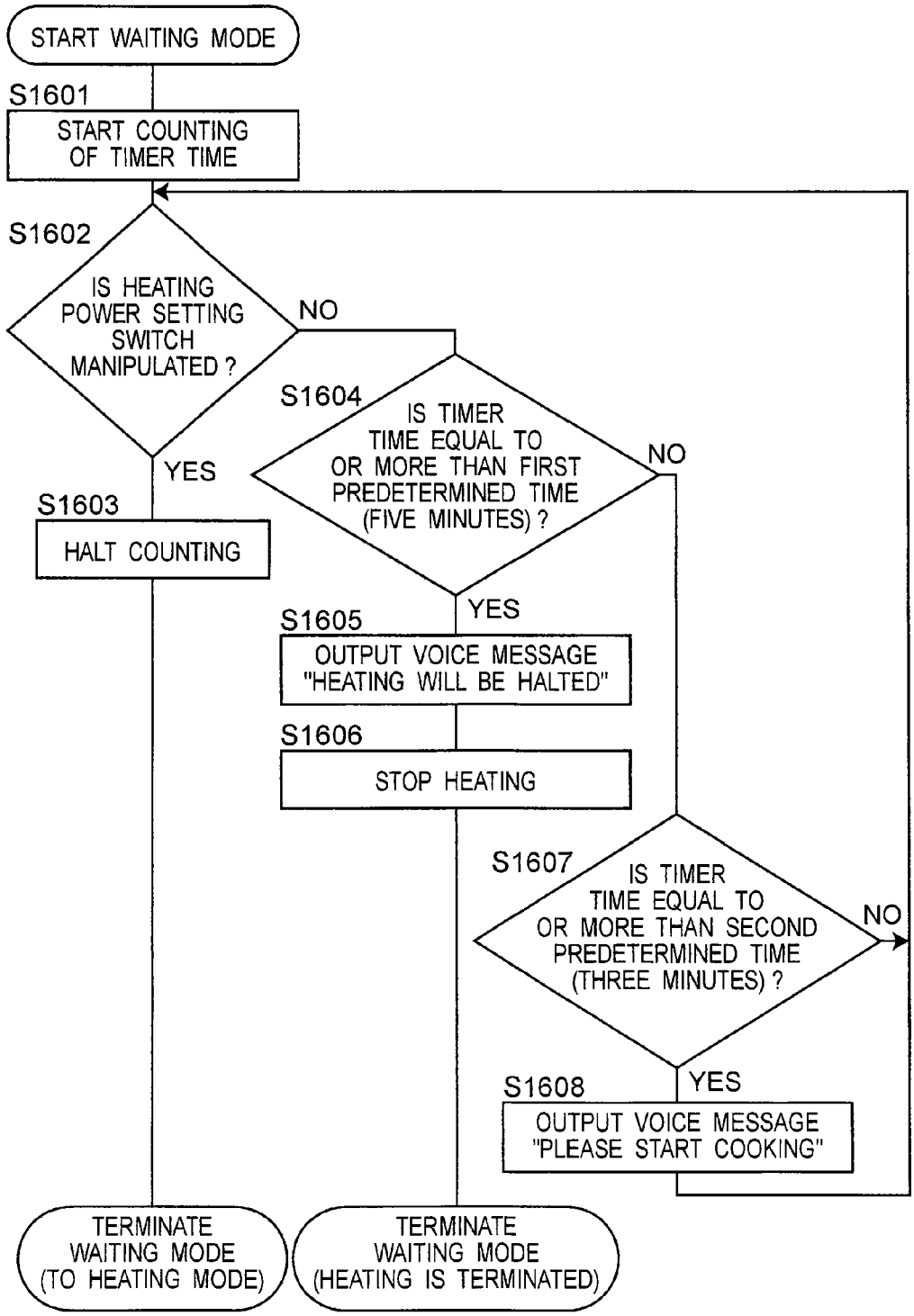
FIG. 16 is a flowchart in a waiting mode according to Embodiment 3 of the present invention.

FIG. 16 illustrates operation performed by the induction heat cooking device according to the present embodiment in the waiting mode. FIG. 16 illustrates a flow relating to a function for stopping heating when the switch is not manipulated for a long time. The operation shown in FIG. 16 is performed in parallel with the operation shown in FIG. 8 relating to the heating control. The timer count unit 20 starts counting the timer time when the operation mode is changed from the preheating mode to the waiting mode (S1601). At this occasion, the timer display unit 12*c* displays how much time is left before the heating is halted (first predetermined time−timer time). The control unit 8 determines whether the heating power setting switches 4*c*, 4*d* are manipulated or not (S1602). When the heating power setting switches 4*c*, 4*d* are determined to be manipulated (Yes in S1602), the timer count unit 20 stops counting (S1603). Thereafter, the waiting mode is terminated, and the operation mode is changed to the heating mode.

When the heating power setting switches 4*c*, 4*d* are determined not to be manipulated (No in S1602), the control unit 8 determines whether or not the timer time measured by the timer count unit 20 exceeds the first predetermined time (for example, five minutes) (S1604). When the timer time is determined to exceed the first predetermined time, the control unit 8 causes the notification unit 13 to output a voice message for notifying that the heating is halted (S1605). For example, the notification unit 13 outputs a voice message "heating will be halted". Thereafter, the control unit 8 stops heating (S1606). When the timer time is determined not to have exceeded the first predetermined time (for example, five minutes), the control unit 8 determines whether or not the timer time exceeds the second predetermined time (for example, three minutes) that is shorter than the first predetermined time (S1607). When the timer time is determined to have exceeded the second predetermined time, the control unit 8 causes the notification unit 13 to output a voice message for prompting the user to cook. For example, the notification unit 13 outputs a voice message "please start cooking". When the timer time is determined not to have exceeded the second predetermined time, the flow is returned to step S1602.

When the user does not perform any operation after the preheating is finished, the heating is halted. Accordingly, the cooking container is prevented from problems. More specifically, the cooking container is prevented from being discolored and damaged.

Further, a voice message for prompting the user to start cooking is outputted before the heating is halted. Accordingly, the voice message can prompt the user to put foods into the cooking container and start cooking before the heating is halted. Therefore, this provides greater convenience for the user. Further, when the heating is halted, a voice message for notifying the halt of the heating is outputted. Accordingly, the voice message can notify the user that the heating is halted.

When the heating power setting switches 4*c*, 4*d* are manipulated in the waiting mode, the counting of the timer time is halted, and the heating is continued. Accordingly, the user can continue cooking when the user wants to cook. Therefore, this provides greater convenience for the user.

In the waiting mode, the timer display unit 12*c* displays the remaining time until the heating is automatically halted, which allows the user to visually, easily understand the remaining time until the termination of the heating. Therefore, the user can be prompted to do cooking.

In the present embodiment, the heating is halted in step S1606. Alternatively, instead of halting the heating, the heating output may be switched to a heating output that is smaller than the current heating output. Even in such case, the same effects as the present embodiment can be obtained.

In the foregoing description of the present embodiment, the heating power setting switches 4*c*, 4*d* are pressed down in step S1602. Alternatively, any switch other than the heating power setting switches 4*c*, 4*d* may be pressed down instead. For example, if the timer switches 4*e*, 4*f* is pressed down in S1602, the same operation as that of the present embodiment may be performed.

In S1608, the voice message for prompting the user to do cooking may be outputted only once after the timer time exceeds the second predetermined time. Alternatively, the voice message may be repeatedly outputted with a predetermined interval (for example, every 30 seconds).

When the user presses down a predetermined switch arranged within the operation unit 4 until the timer time reaches the first predetermined time, the count value of the timer time may be reset, and the count may be started all over again. When the timer time reaches a third predetermined time (for example, 10 minutes) that is longer than the first predetermined time (for example, 5 minutes), the heating may be halted. With this configuration, even when the user manipulates the switch so as to do cooking but thereafter forgets to turn off the heating, the heating can be automatically halted, and the safety can be improved.

In the present embodiment, the operation in the waiting mode has been described. Further, when the user does not manipulate the switch for a long time in the heating mode, the heating output may be reduced to a heating output that is smaller than the current heating output, or the heating may be halted. For example, the timer count unit 20 may measure a time from when the operation mode is changed to the heating mode, and between step S901 and step S902 of FIG. 9, a determination may be made as to whether the measured time exceeds a fourth predetermined time (for example, 45 minutes). When the predetermined time has elapsed, the heating output may be reduced to a heating output that is smaller than the current heating output, or the heating may be halted. Therefore, the heated object is prevented from being discolored or deteriorated (for example, deterioration of coated fluorine resin). It should be noted that the first predetermined time in the waiting mode is preferably set smaller than the fourth predetermined time in the heating mode.

In a case where the user does not perform any operation after the preheating is finished, the induction heat cooking device according to the present embodiment can stop heating before the cooking container is discolored and damaged, and can perform heating without causing problems in the cooking container. Therefore, the induction heat cooking device according to the present embodiment is useful for an induction heat cooking device used in ordinary households and commercial-use kitchens.

INDUSTRIAL APPLICABILITY

The induction heat cooking device according to the present invention can finish preheating in a short time when the load is small, and can maintain the temperature after the finish of the preheating. Therefore, the induction heat cooking device according to the present invention is useful for an induction heat cooking device used in ordinary households and restaurants in which stir-fried food and the like are cooked.

The invention claimed is:

1. An induction heat cooking device comprising:

a top plate made of a material through which an infrared light is transmitted;

a heating coil configured to receive a high frequency current to heat a cooking container placed on the top plate by induction;

an inverter circuit configured to provide the high frequency current to the heating coil;

an operation unit including an operation mode setting unit configured to set an operation mode of the inverter circuit and a heating power setting unit configured to set a heating power of the inverter circuit, wherein the operation mode includes a preheating heating mode operating at a first power setting for performing preheating before performing heating;

an infrared sensor configured to detect an infrared light that is emitted from a bottom surface of the cooking container and transmitted through the top plate;

a notification unit, a control unit configured to perform operations comprising:

when the operation mode is set to the preheating heating mode, causing the inverter to provide a first heating output to the heating coil;

prevent any change to the heating power when a heating power setting different from the first power setting is input by the user via the heating power setting unit while the operation mode is in the preheating mode;

determining an incremental output value of the infrared sensor;

when the increment output value of the infrared sensor is more than a first predetermined increment value:

causing the notification unit to notify a user that the preheating is finished; and causing the operation mode to be changed to a waiting mode in which the inverter outputs a second heating output to the heating coil that is lower than the first heating output, and when the user inputs a heating power setting while the operation mode is in the waiting mode, causing the operation mode to be changed to a heating mode in which the inverter outputs a third heating output to the heating coil corresponding to the heating power setting input by the user while the operation mode is in the waiting mode.

2. The induction heat cooking device according to claim 1, wherein the control unit is configured to cause the operation mode to change to the waiting mode when the increment of the output value of the infrared sensor with respect to a predetermined initial output value exceeds the first predetermined increment, instead of the increment of the output value of the infrared sensor since the heating starts with the first heating output, and wherein the predetermined initial output value is an output value of the infrared sensor that is obtained when the cooking container, having such a temperature that the gradient of increase in the output of the infrared sensor with respect to a change of temperature of the cooking container is equal to or less than a predetermined value, is placed on the top plate.

3. The induction heat cooking device according to claim 1 further comprising a timer count unit configured to count a time from when the operation mode is changed to the waiting mode, wherein when the time counted by the timer count unit reaches a first predetermined time in the waiting mode, the control unit is configured to halt heating or change the second heating output to a smaller heating output.

4. The induction heat cooking device according to claim 3, wherein when the time counted by the timer count unit reaches a first predetermined time, the control unit is configured to cause the notification unit to notify the user that the heating is halted or the second heating output is changed to the smaller heating output.

5. The induction heat cooking device according to claim 3, wherein when the time counted by the timer count unit reaches a second predetermined time that is shorter than the first predetermined time, the control unit is configured to cause the notification unit to issue a notification for prompting the user to start cooking.

6. The induction heat cooking device according to claim 3, wherein the operation unit includes a plurality of switches, and wherein the timer count unit is configured to stop counting when a predetermined switch in the operation unit is pressed down before the counted time reaches the first predetermined time.

7. The induction heat cooking device according to claim 3, wherein the operation unit includes a plurality of switches, and wherein when a predetermined switch in the operation unit is pressed down before the counted time reaches the first predetermined time, the timer count unit is configured to reset counting and start counting all over again, and the timer count unit resets the first predetermined time to a third predetermined time that is longer than the first predetermined time, wherein when the counted time since the resetting reaches the third predetermined time, the heating is halted, or the second heating output is changed to a smaller heating output.

8. The induction heat cooking device according to claim 3 further comprising a numerical display unit configured to display a number, wherein the numerical display unit is further configured to display how much time it takes for the time counted by the timer count unit to reach the first predetermined time.

9. The induction heat cooking device according to claim 1 further comprising a heating power display unit configured to display a heating power, wherein the heating power display unit is configured to not display the heating power in the preheating heating mode, and to display the heating power after the operation mode is changed to the waiting mode.

10. The induction heat cooking device according to claim 1 further comprising an operation mode display unit configured to display a mark representing the operation mode, wherein in the preheating heating mode, the operation mode display unit is configured to light a heating mark indicating that the heating is performed and blink a preheating mark indicating that the preheating function is operated.

11. The induction heat cooking device according to claim 10, wherein when the operation mode is changed to the waiting mode, the operation mode display unit is configured to stop blinking the preheating mark and light the preheating mark.

12. The induction heat cooking device according to claim 11, wherein when the operation mode is changed to the heating mode, the operation mode display unit is configured to light the heating mark and turn off the preheating mark.

13. An induction heat cooking device comprising:

a top plate made of a material through which an infrared light is transmitted;

a heating coil configured to receive a high frequency current to heat a cooking container placed on the top plate by induction;

an inverter circuit configured to provide the high frequency current to the heating coil;

an operation unit including an operation mode setting unit configured to set an operation mode of the inverter circuit and a heating power setting unit configured to set a heating power of the inverter circuit, wherein the operation mode includes a preheating heating mode operating at a first power setting for performing preheating before performing heating, a waiting mode operating at a second power setting that is different from the first power setting, and a heating mode operating at a third power setting that is different from the first power setting;

an infrared sensor configured to detect an infrared light that is emitted from a bottom surface of the cooking container and transmitted through the top plate;

a notification unit, a control unit configured to perform operations comprising:

when the operation mode is set to the preheating heating mode, causing the inverter to provide a first heating output to the heating coil;

while the operation mode is in the preheating mode:

prevent any change to the operation mode input by the user via the operation unit; and prevent any change to the heating power when a heating power setting different from the first power setting is input by the user via the heating power setting unit while the operation mode is in the preheating mode;

determining an incremental output value of the infrared sensor;

when the increment output value of the infrared sensor is more than a first predetermined increment value:

causing the notification unit to notify a user that the preheating is finished; and causing the operation mode to be changed to a waiting mode in which the inverter outputs a second heating output to the heating coil that is lower than the first heating output, and when the user inputs a heating power setting while the operation mode is in the waiting mode, causing the operation mode to be changed to the heating mode in which the inverter outputs a third heating output to the heating coil corresponding to the heating power setting input by the user while the operation mode is in the waiting mode.

* * * * *